United States Patent [19]

Bigelow et al.

[11] Patent Number: 4,534,557

[45] Date of Patent: Aug. 13, 1985

[54] REACTION TIME AND APPLIED FORCE FEEDBACK

[76] Inventors: Stephen L. Bigelow, 189 Ventnor Ave., Aspen, Colo. 81611; John A. Carlin, 1795 S. St. Paul, Denver, Colo. 80210

[21] Appl. No.: 496,985

[22] Filed: May 25, 1983

Related U.S. Application Data

[63] Continuation of Ser. No. 246,267, Mar. 23, 1981, abandoned.

[51] Int. Cl.[3] ..... A63B 69/00

[52] U.S. Cl. ..... 273/55 A; 273/55 R; 273/1 GC; 273/1 GE; 273/55 B; 272/76; 73/379; 434/247

[58] Field of Search ..... 272/76; 273/1 GC, 1 GE, 273/55 R, 55 A; 73/379; 364/506, 507; 434/247, 251

[56] References Cited

U.S. PATENT DOCUMENTS

| | | | |
|---|---|---|---|
| 1,170,467 | 2/1916 | Taylor | 272/76 |
| 3,933,354 | 1/1976 | Goldfarb | 273/1 E |
| 4,027,875 | 6/1977 | Hurley | 272/76 |
| 4,084,811 | 4/1978 | Kyo | 272/76 |
| 4,088,315 | 5/1978 | Schemmel | 272/76 |
| 4,108,428 | 8/1978 | Winterbottom | 272/76 |

FOREIGN PATENT DOCUMENTS 2725662 7/1979 Fed. Rep. of Germany ... 273/1 GC

OTHER PUBLICATIONS

E. B. Jones, "*Instrument Technology vol. I, Measurement of Pressure, Level, Flow and Temperature*", 3/6/75, pp. 20 and 21.

*Primary Examiner*—Richard C. Pinkham
*Assistant Examiner*—Leo P. Picard
*Attorney, Agent, or Firm*—Robert C. Dorr

[57] ABSTRACT

A reaction time and applied force feedback training system for sports includes at least one sport training device, a stimulus indicator located near and associated with the sport training device for emanating a plurality of ready signals at random time intervals, a sensor in the sport training device receptive of a force applied to the sport training device in response to each of the ready signals for generating an electrical signal having a magnitude proportional to the magnitude of the applied force that force being the difference between an initialized zero force for the ambient pressure at that time and the applied force, and a control unit for controlling the emanation of the ready signals and for determining and displaying the reaction time from emanation of the ready signal to sensing the applied force and for determining and displaying the magnitude of the applied force.

4 Claims, 21 Drawing Figures

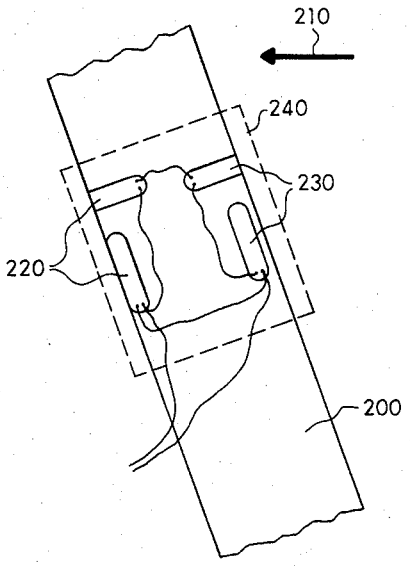
Fig. 2
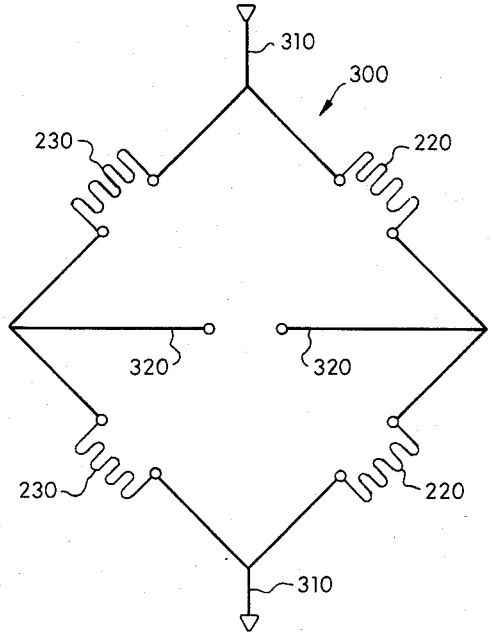
Fig. 3
Fig. 4
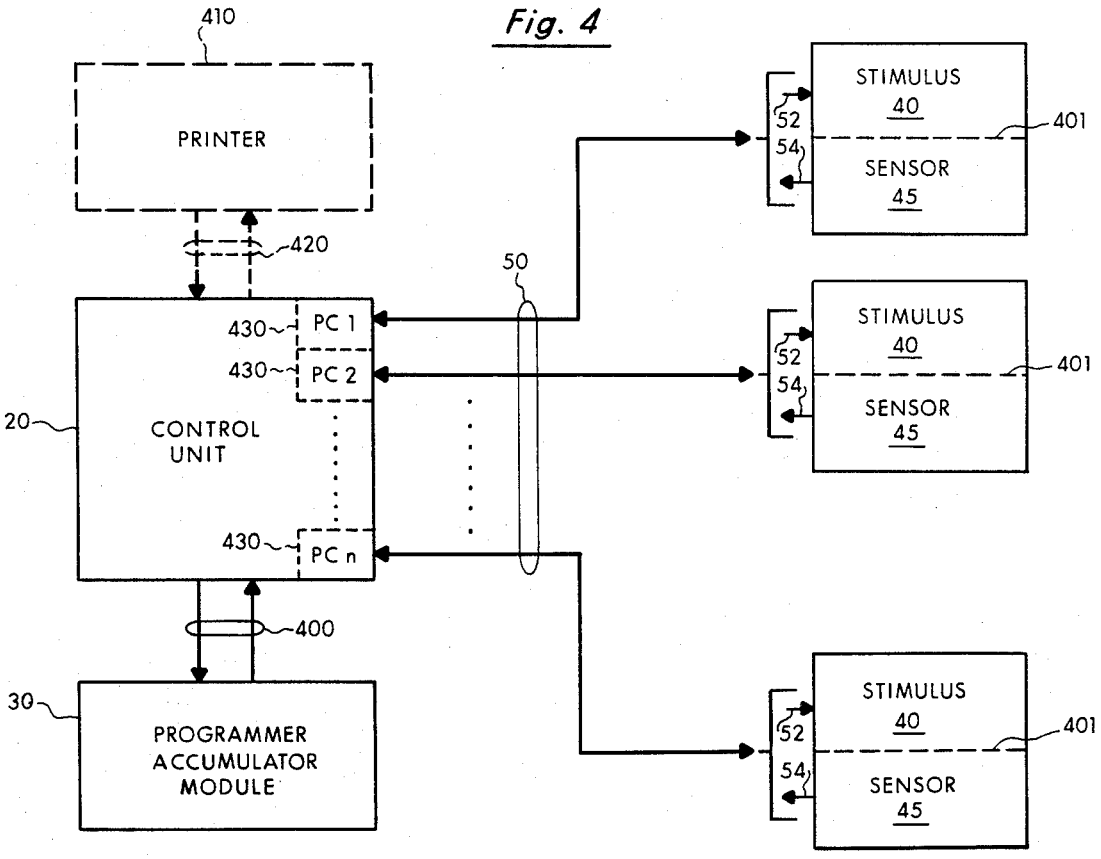

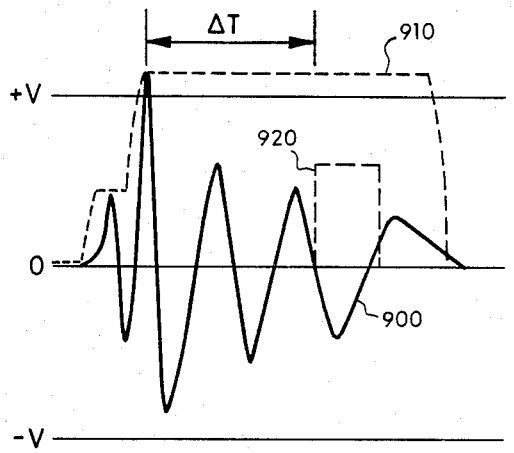
Fig. 9
Fig. 11
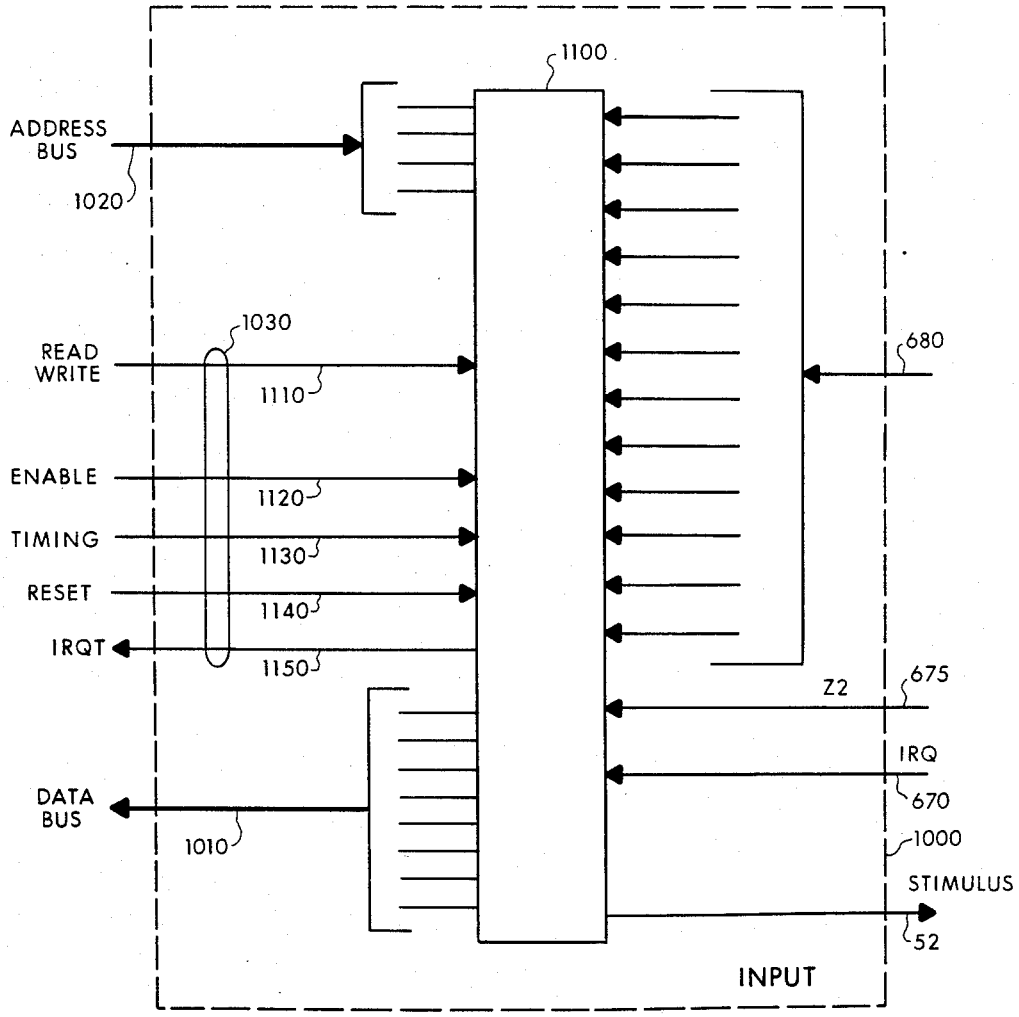

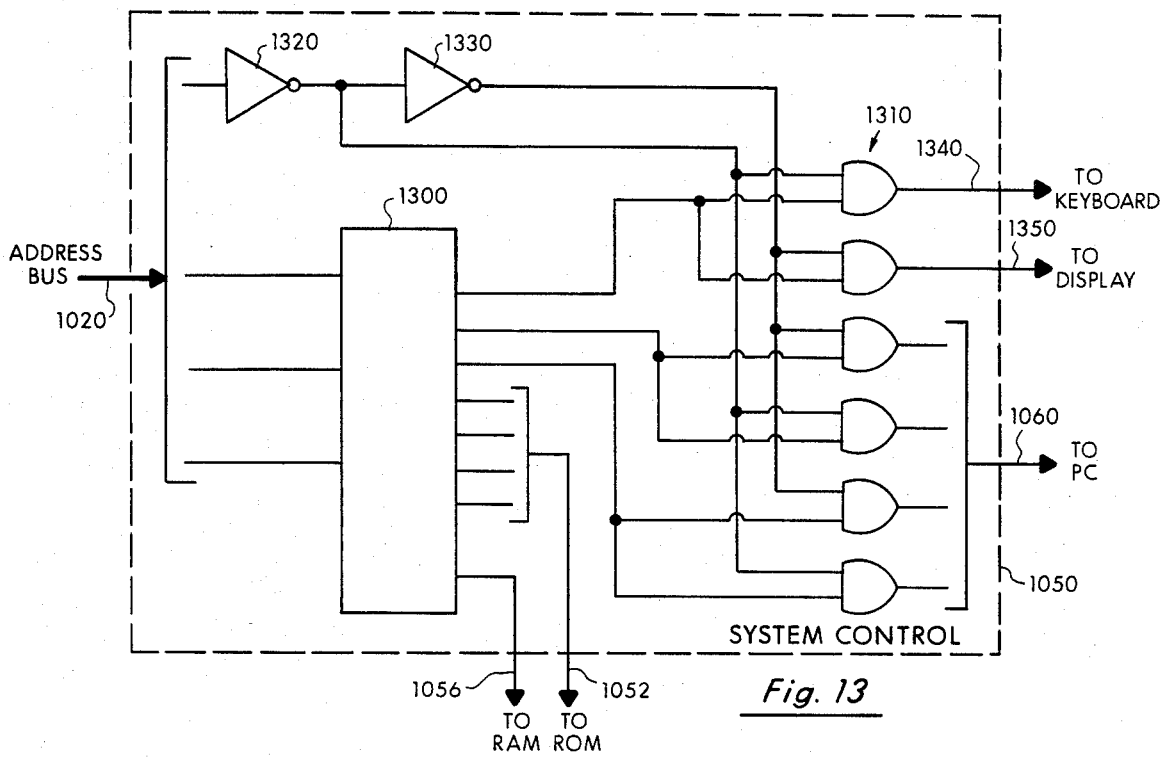
Fig. 13
Fig. 14
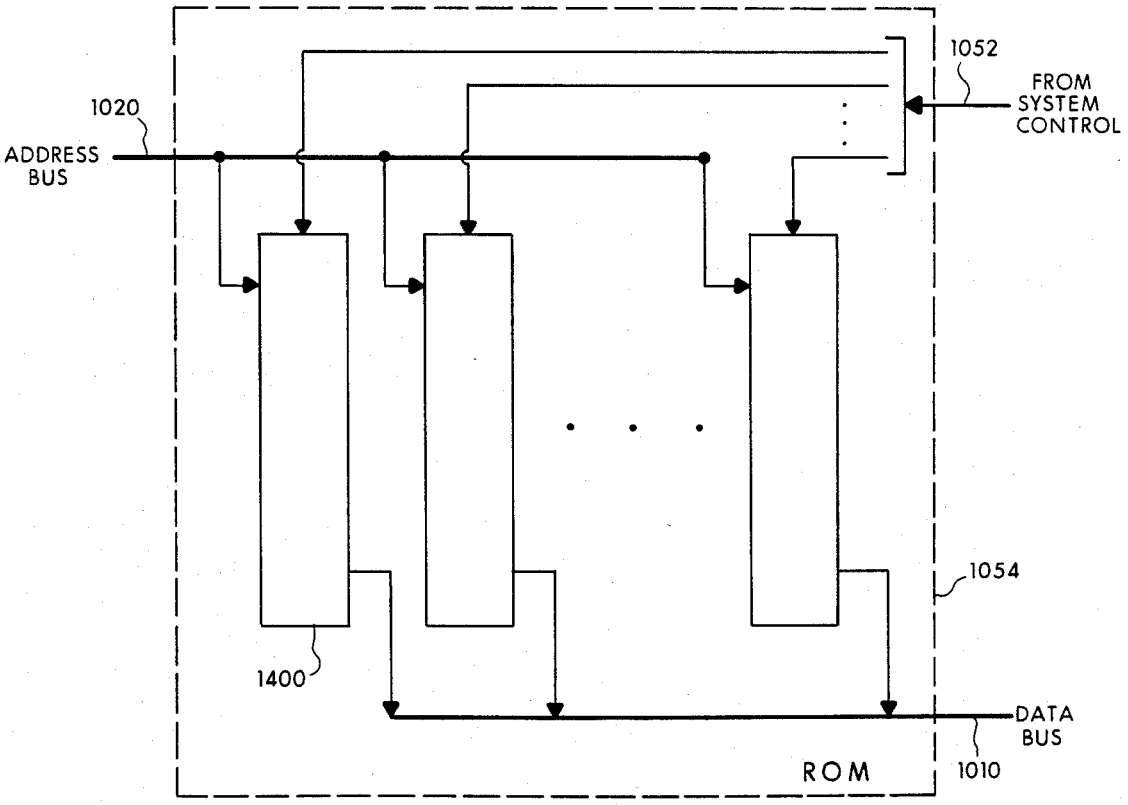

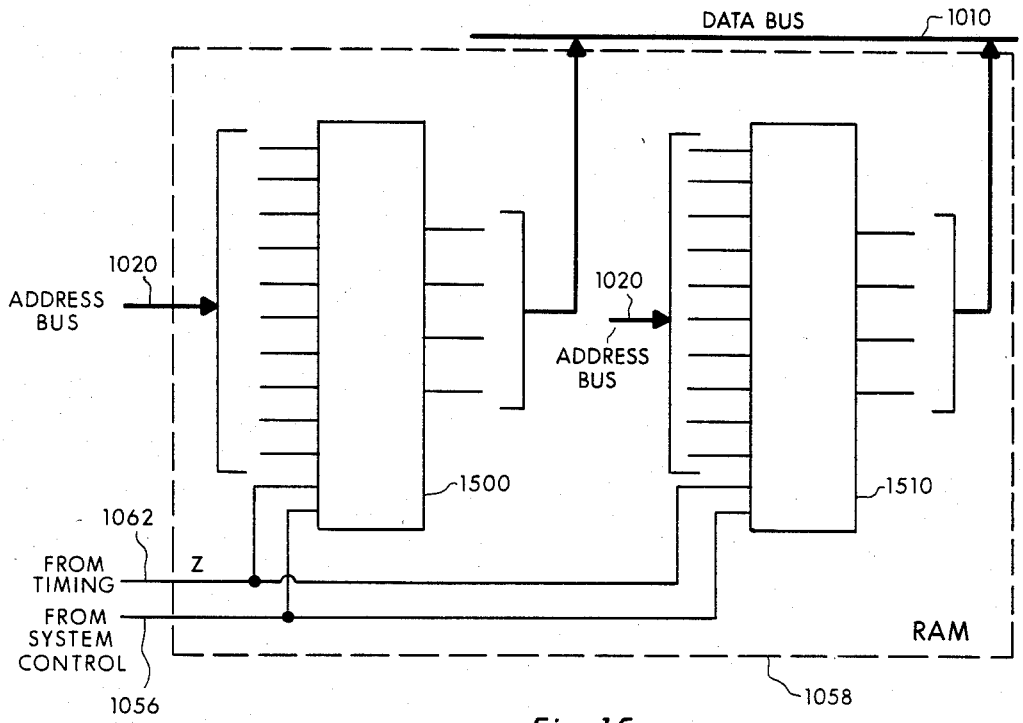
Fig. 15
Fig. 16
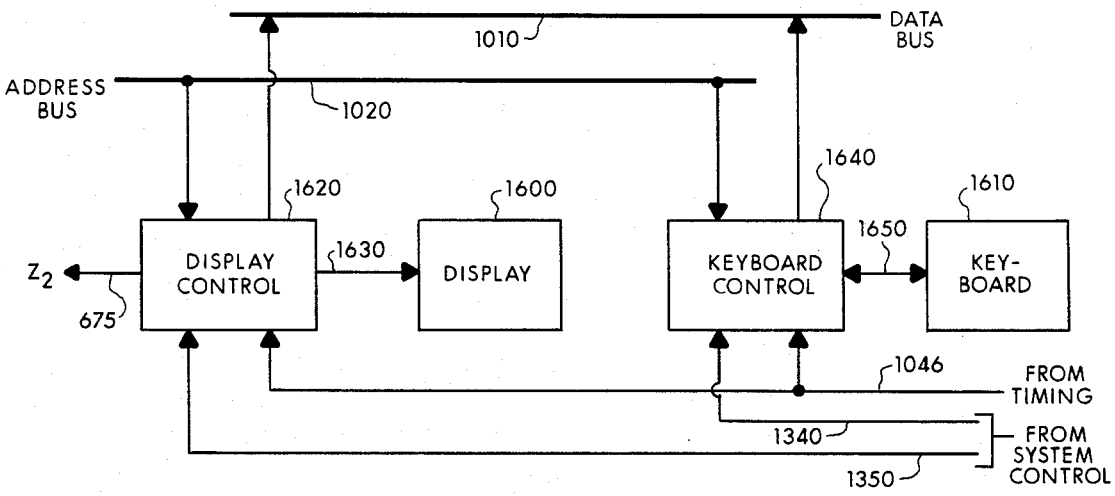

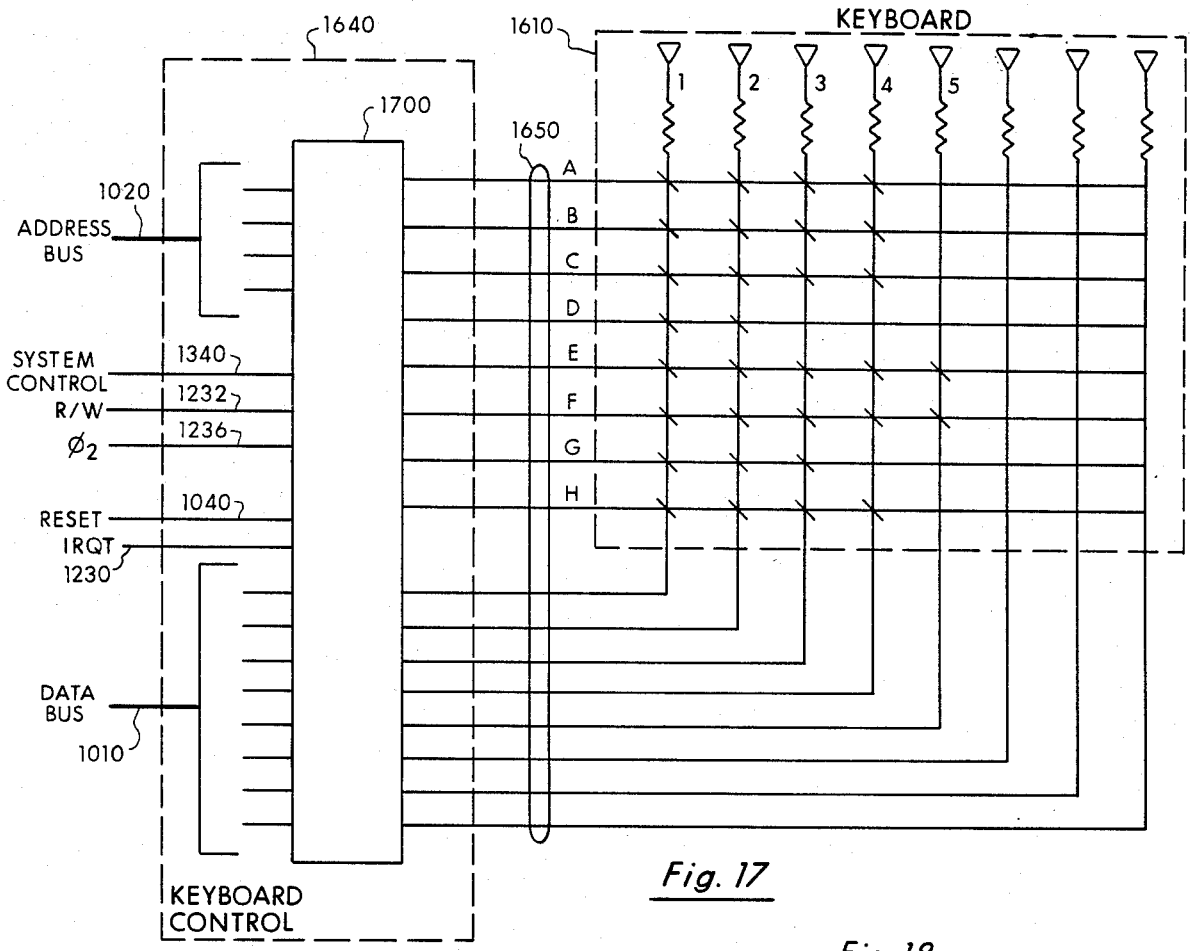
Fig. 17
Fig. 18
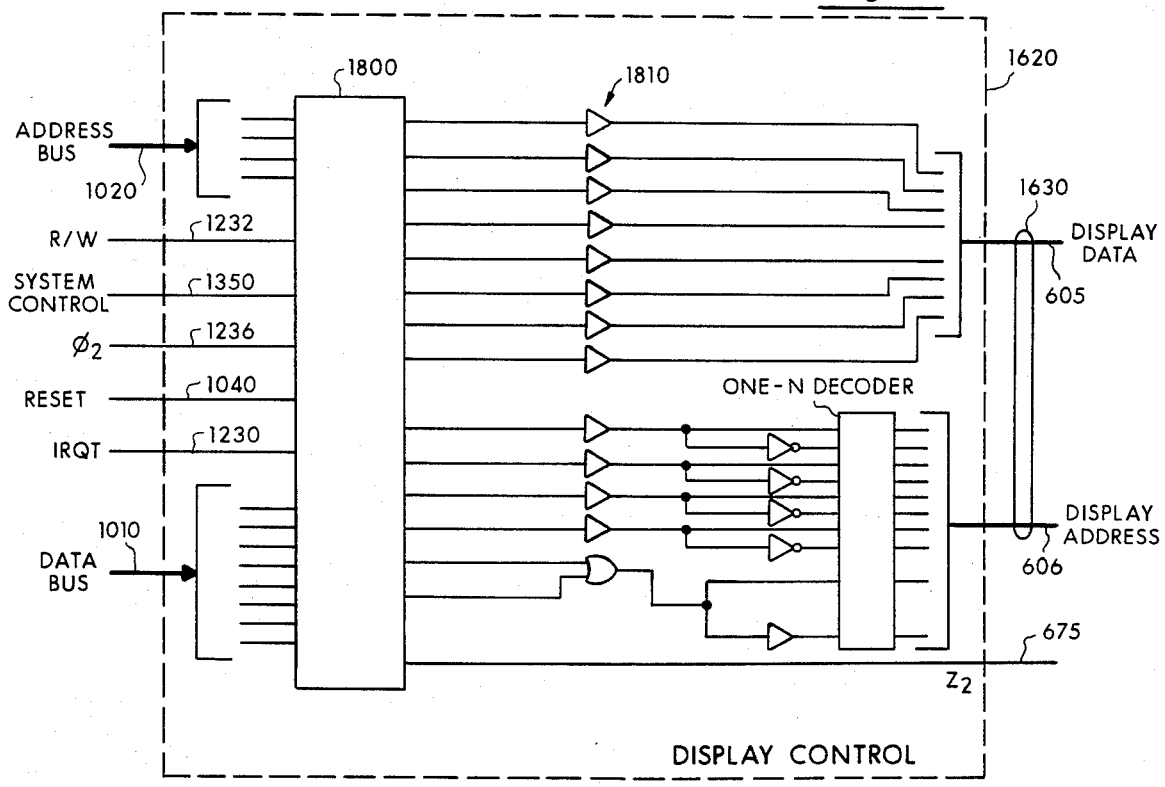

REACTION TIME AND APPLIED FORCE FEEDBACK

This is a continuation of application Ser. No. 246,267 filed Mar. 23, 1981, now abandoned.

BACKGROUND OF THE INVENTION

1. Field of the Invention

The present invention relates to the field of sports training systems and, more particularly, to sports training devices providing reaction time and applied force feedback information.

2. Discussion of the Prior Art

Prior to the filing of the application of the present invention, the inventors conducted a patentability investigation for a system that feedbacks reaction time and applied force in the sport of martial arts. The following patents were uncovered:

| Name | Title | U.S. Pat. No. | Date |
|---|---|---|---|
| L. B. Taylor | Exercising Apparatus | 1,170,467 | 2-1-16 |
| Goldfarb et al | Reflex Testing Amusement Device | 3,933,354 | 1-20-76 |
| Hurley | Reaction Speed Training Device | 4,027,875 | 6-7-77 |
| Kyo | Hitting Device For Martial Arts | 4,084,811 | 4-18-78 |
| Schemmel | Device For Self-Defense Training | 4,088,315 | 5-9-78 |

The 1916 patent issued to Taylor as U.S. Pat. No. 1,170,467 relates to a baseball training apparatus wherein a baseball bat is used to strike a sensor ball. The struck ball compresses a charge of air which in turn activates the opening of an electric switch. The Taylor apparatus provides a measurement of the force or the value of the blow which is visually fed back to the user of the apparatus. The Taylor apparatus operates each time the sensor ball is hit.

The 1976 patent issued to Goldfarb, et al as U.S Pat. No. 3,933,354 discloses a training device for reflex testing in the martial arts. The Goldfarb training device utilizes a picture of a combatant which utilizes a series of lights at certain discrete points. When these points are illuminated, the user of the training device must rapidly extinguish the light by touching the picture at the point of illumination. The lights of Goldfarb, et al are illuminated in a random or pseudo-random order so that the user of the training device cannot anticipate the sequence. The reaction time of each hit is recorded.

The patent issued to Hurley as U.S. Pat. No. 4,027,875, also sets forth a reaction time device for use in training for the martial arts. The Hurley device measures the reaction time of a student or trainee in moving from a first designated point to a second designated point and applying a force at that point.

The patent issued to Kyo as U.S. Pat. No. 4,084,811 sets forth a hitting device for training in the martial arts. Kyo utilizes a cylindrically shaped corrugated bellows apparatus which is capable of compressing along a central axis when a force is applied to it. The approximate magnitude of the force is displayed by means of a gauge similar to a conventional tire gauge having a moveable indicator.

The patent issued to Schemmel as U.S. Pat. No. 4,088,315 sets forth a self defense training device which utilizes a life-like training dummy supported in an upright position. The Schemmel approach utilizes sensors contained within the dummy for indicating the force of the blow and visual indication as to the force of the blow such as different colored lights and different degrees of force. The control unit for the dummy includes a printout mechanism that records the passage of time between target blows.

A systematic and multi-functional approach to measuring reaction time and applied forces for sport training devices, is not found in any of the above prior art approaches. The system of the present invention provides for the determination of both the reaction time and the applied force for one or for a number of different sports training devices. Furthermore, the stimulus ready signals can be randomly generated both temporally and spacially among different sports training devices.

SUMMARY OF THE INVENTION

The reaction time and applied force feedback training system of the present invention includes a stimulus indicator located near and associated with a training device such as a football or body bag for emanating training signals, a sensor in the training device for sensing any applied force to the device in response to the emanation of training signals from the stimulus indicator, and a control unit for controlling the emanation of the training signals and for determining and displaying the reaction times and magnitude of the applied force.

DESCRIPTION OF THE DRAWINGS

FIG. 2 sets forth an illustration of four stress sensors being mounted to the bar of a sports training device;

FIG. 3 is an electrical sensor circuit for the embodiment shown in FIG. 2;

FIG. 4 is a block diagram of the major components of the training system of the present invention;

FIG. 9 is a graphical illustration of several of the wave forms occurring in the system of the present invention;

FIG. 11 is the electronic circuit diagram for the input circuit of the present invention;

FIG. 13 is the electronic circuit diagram for the system control of the present invention;

FIG. 14 is the electronic circuit diagram for the read only memory of the present invention;

FIG. 15 is the electronic circuit diagram for the random access memory of the present invention;

FIG. 16 sets forth the block diagram embodiment of the display and keyboard functions of the present invention;

FIG. 17 sets forth the electronic circuit for the keyboard control of the present invention;

FIG. 18 is the electronic circuit for the display control of the present invention;

GENERAL DESCRIPTION

Figure 1:
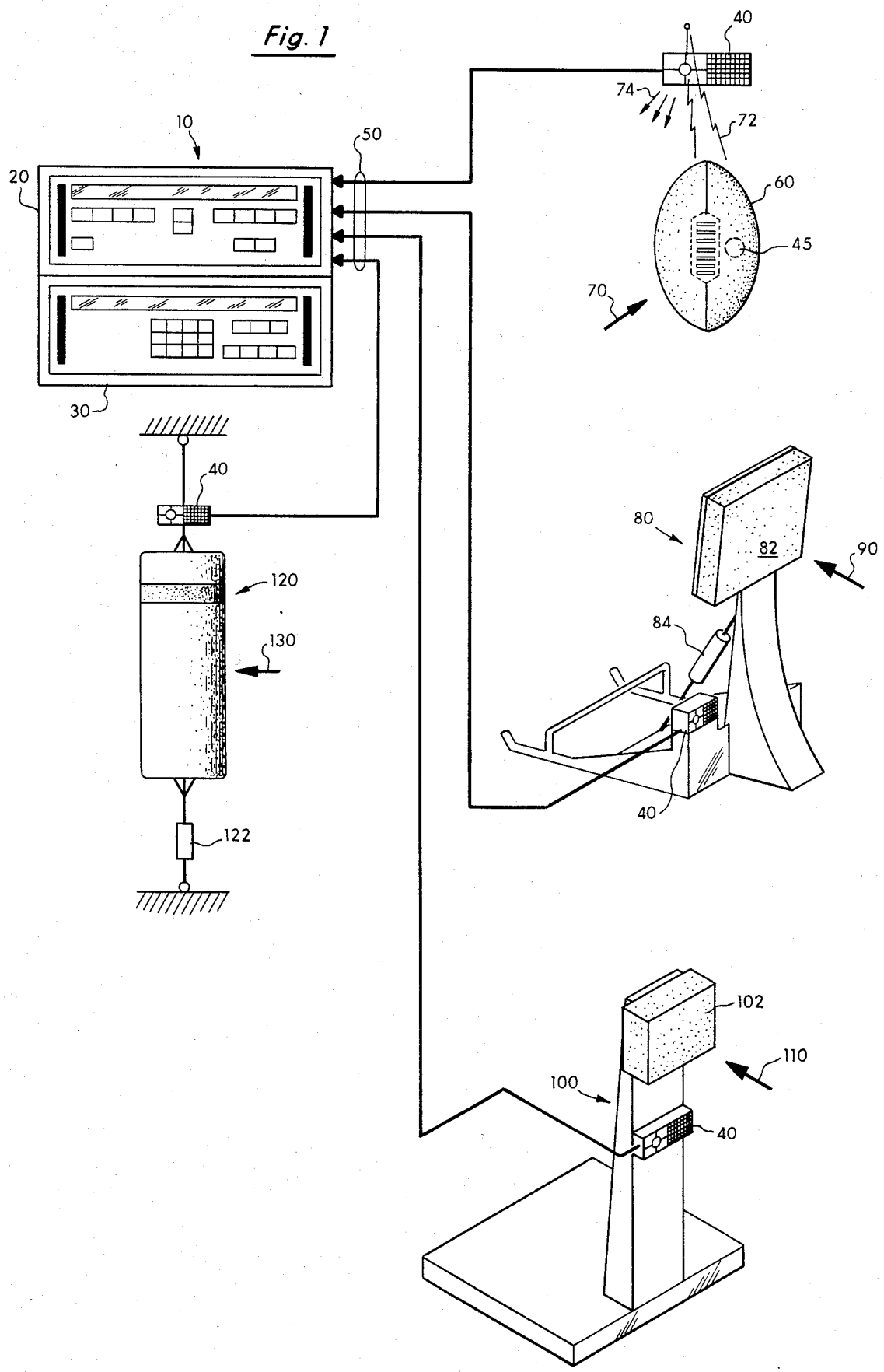
FIG. 1 sets forth an illustration of the training system of the present invention being used for a number of different sports training devices.

In FIG. 1, the feedback training system 10 of the present invention is shown adapted, for illustration purposes, for a number of different sport activities. The feedback training system 10 includes a control unit 20, a programming accumulator module 30, and a plurality of stimulus indicators 40. Each stimulus indicator 40 communicates over one of the personality channels 50.

Each of these sport activities in the application of the feedback training system 10 of the present invention will now be discussed. A conventional football 60 can be adapted to contain a pressure transducer (generally shown as element 45) interconnected with a radio transmitter so that when a force 70 is applied to the football, such as in kicking the football, the amount of force applied can be sensed and transmitted over radio waves 72 to a stimulus indicator 40 which contains a receiver. The stimulus indicator 40 thereupon generates an electrical signal proportional to the amount of applied force sensed by the football 60 for delivery over one of the personality channels 50 and into the control unit 20. The amount of the applied force will then be displayed by the control unit 20 and the amount of force can be audibly generated in stimulus indicator 40 as a tone wherein the frequency of the tone varies with the magnitude of the force.

Furthermore, the feedback training system of the present invention also provides a measurement of the reaction time. In this mode of operation, the control unit 20 provides an electrical command signal over one of the personality channels 50 to the stimulus indicator 40 so that an audible sound or visible light can be emanated as indicated by arrows 74. Upon hearing the audible sound 74 (or upon seeing a visual light), the kicker will kick the football 70. When the kick is sensed by the pressure transducer 45 located inside the football 60, that signal is transmitted 72 into the stimulus indicator 40 for delivery back to the control unit 20. Hence, the reaction time as well as the applied force of the kick can be accurately measured.

In another application, also adapted for football usage, a conventional blocking pad 80 can be modified so that attached to the padded striking area 82 are pressure transducers 84. These pressure transducers 84 are electrically interconnected with the stimulus indicator 40 and operate in the same fashion as above. An audible command 74 is given by the stimulus indicator 40, a force 90 is applied by a football player to the striking pad 82, the application of the force is sensed by transducer 84 and the amount of the force is determined and displayed. The amount of force can be fed back to the blocking pad as a predetermined tone.

For striking posts 100 that are used in various martial arts, the reaction time and amount of force 110 applied can also be measured. The striking post 100 can hit by the feet or hands of a martial artist and the force and reaction time can be detected by transducers, not shown, implanted in the pad area 102 of the post 100. Again, in operation, a stimulus would be generated by the stimulus indicator 40, the martial artist would then strike the post and the reaction time and magnitude of force would be measured. For these types of application, the feedback signals can vary. For example, as long as the strikes are fast enough and hard enough no tone would be generated in indicator 40. The instant a strike is too slow or too weak a tone could be generated to identify which event occurred. The threshold levels for reaction time and strike magnitude are present in the control unit 20.

The body bag 120 could be used by martial artists or boxers or by football players as a tackling dummy and could incorporate sensors in the bag, not shown, and/or sensors 122 on the bag support. The operation would be as described above for the striking post 100.

Under the teachings of the present invention, for example, up to four martial arts striking posts 100 or bags 120 can be utilized either with four separate users with each user having his or her reaction time and amount of force measured or with one user being spatially surrounded with four separate striking posts 100 or bags 120 so that the user on receiving a stimulation signal 74 from any one of the posts 100 can strike that post. As will be discussed in the following, when a single user is surrounded by four striking posts 100, the stimulation signals 74 coming from each stimulation indicator 40 can be randomly generated so that the user does not know which post he or she is to hit or when (temporal and spatial training).

In FIGS. 2 and 3 are set forth the details of one form of pressure transducer, as for example transducer 84 in FIG. 1, that could be used under the teachings of the present invention. In FIG. 2, a support bar 200 is subjected to a force 210. Affixed to the support bar 200 are a plurality of compression sensors 220 and a plurality of tension sensors 230. The compression and tension sensors 220 and 230 are affixed onto the support bar 200 and a protective coating 240 is applied over the sensors. The sensors 220 and 230 are electrically interconnected as shown in FIG. 3 into a conventional strain gauge circuit 300. An excitation voltage 310 is applied to the circuit and an electrical signal proportional to the force 210 is provided on leads 320.

It is to be expressly understood, that the approach set forth in FIGS. 2 and 3 for measurement of the amount of force being applied is representative and that a number of different techniques and circuits could be utilized. The essence of the present invention is set forth in FIG. 4 and is independent of the type of sensor 45 and circuit 300 being used.

DETAILED DESCRIPTION

As set forth in FIG. 4, any number of stimulus indicators 40 and sensors 45 can be interconnected over personality channels 50 to the control unit 20. The control unit 20 maintains two-way communication over leads 400 with the programmer accumulator module 30 and with printer 410 over leads 420. The printer 410 is optional and provides a permanent written record of the various reaction times and applied forces sensed. Each stimulus indicator 40 and sensor 45 accesses, over a given personality channel 50, a unique personality circuit 430.

Each personality channel 50 contains a set of leads 52 which communicate with the stimulus indicator 40 and a set of leads 54 which communicate with the sensor 45. As per FIG. 1, leads 54 could be reduced to a radio link. As mentioned for FIG. 3, the sensor circuit 45 can be any of a number of conventional or other approaches. In FIG. 4, the stimulus indicator 40 is located near and associated with the sensor 45 in the sports training device as indicated by dotted line 401.

Figure 5:
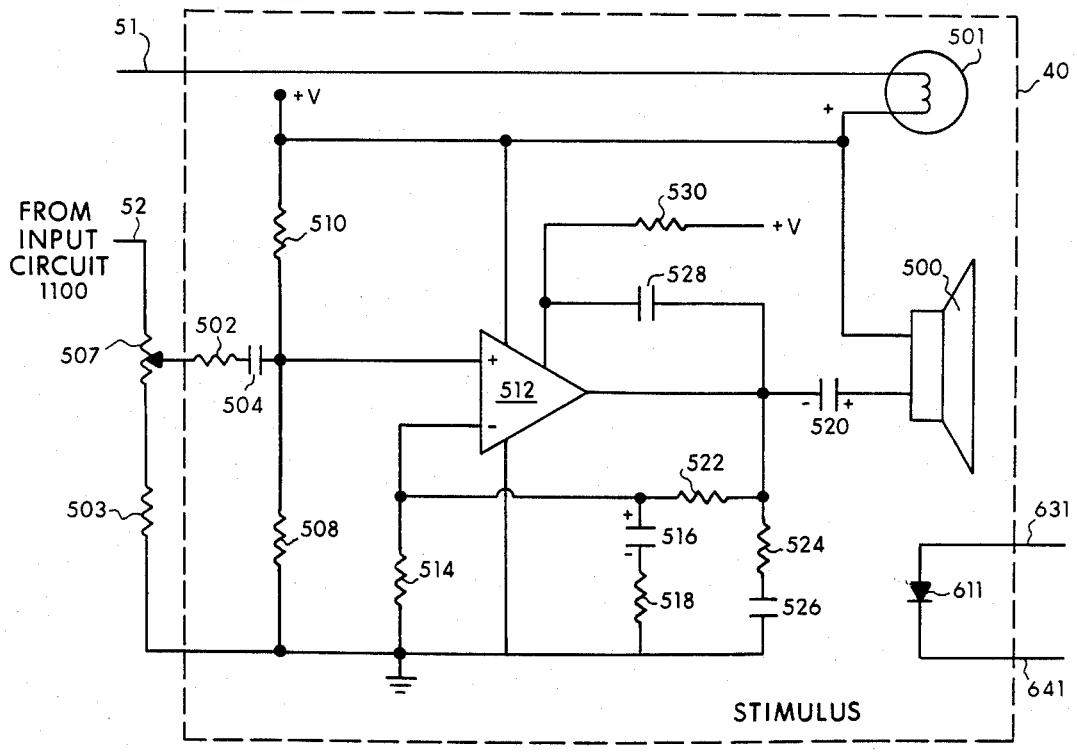
FIG. 5 is a circuit diagram of the stimulus indicator circuit of the present invention.

The stimulus indicator 40 is set forth in FIG. 5. Lead 52 is delivered over the personality channel 50 from its unique personality circuit 430 in the control unit 20. On lead 52 is an electrical signal that causes loud speaker 500 to be audible from the input circuit 1100 (to be discussed). Lead 52 is connected through rheostat 507 and resistor 503 to ground, the top of rheostat 507 is connected through resistor 502 and capacitor 504 to the PLUS input of AUDIO IC amplifier 512. The MINUS input to the AUDIO IC amplifier 512 is grounded through resistor 514. The MINUS input is further interconnected through capacitor 516 and resistor 518 to ground. The output of the AUDIO IC amplifier 512 is interconnected through capacitor 520 to activate the loud speaker 500. The output of AUDIO IC amplifier 512 is also connected through resistor 522 to the MINUS input and the output is further delivered through resistor 524 and capacitor 526 to ground. The output is also delivered through capacitor 528 back into the AUDIO IC amplifier. In operation, a series of pulses are delivered on lead 52 at a frequency which can be varied. The variation of this frequency is controlled by the control unit 20 and provides a tone in loudspeaker 500 which has a frequency proportional to the magnitude of the applied force 210. For example, the higher the frequency the greater the force (or vice versa).

Additionally, FIG. 5 sets forth a visual indicator 501 under control of lead 51. When a low or ground condition is on lead 51, light 501 becomes activated to emanate a READY signal. When the READY signal is emanated the user of the training system of the present invention will apply the force to the sports training device.

Figure 6:
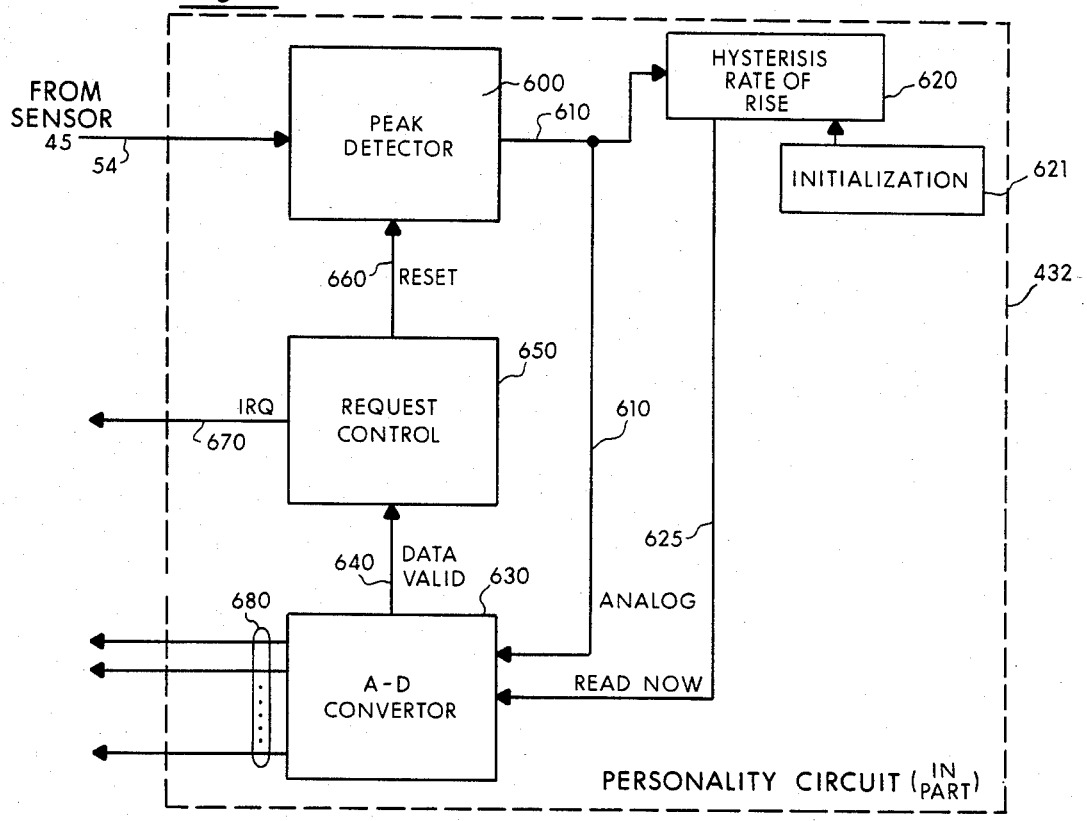
FIG. 6 is a block diagram of a portion of the personality circuit of the present invention.
Figure 10:
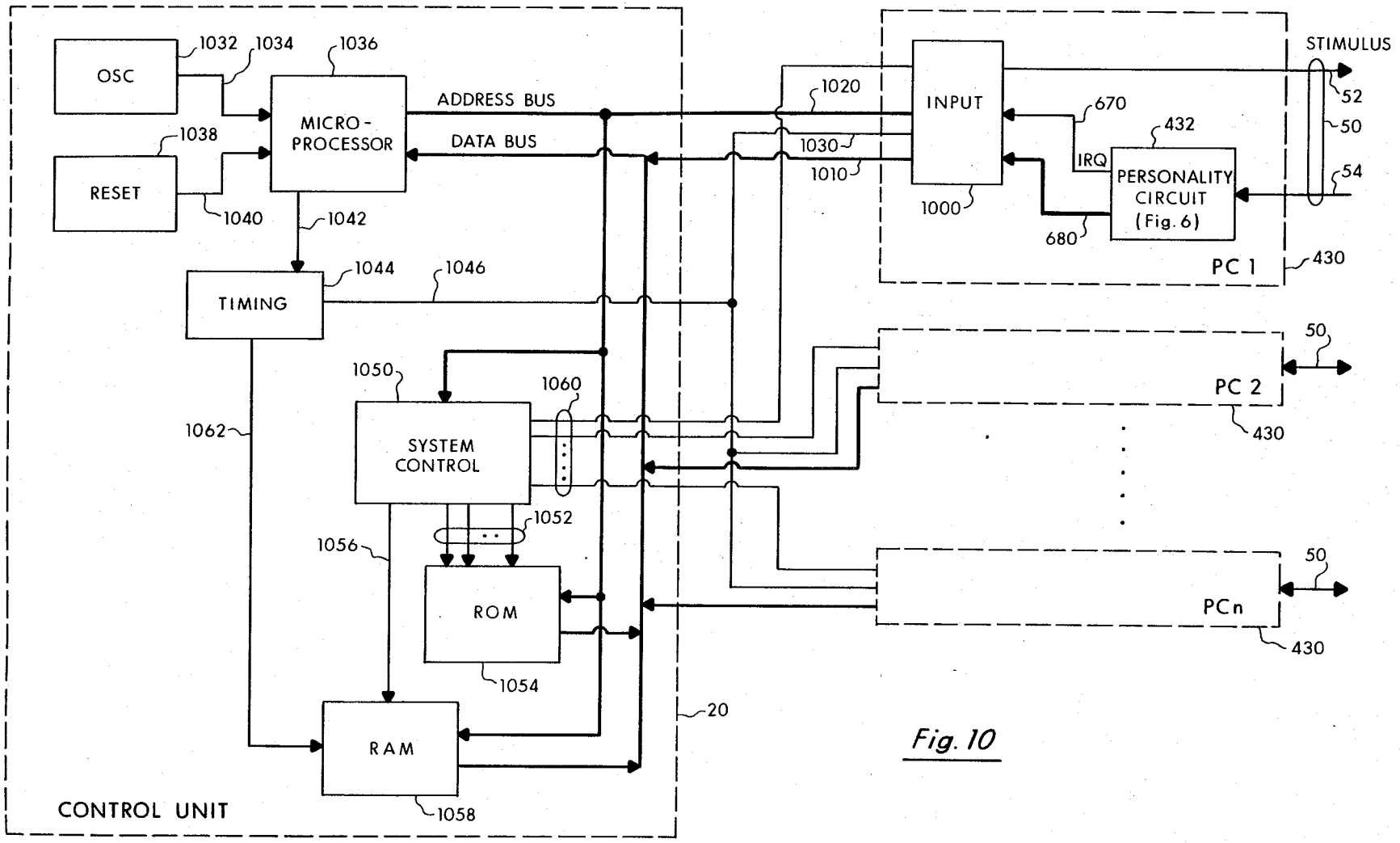
FIG. 10 sets forth, in block diagram format, the components of the control unit of the present invention.

In the preferred embodiment, the value of the various components are:

Resistor 502 and 503—10 Kohm
Capacitor 504—0.33 microfarad
Rheostat 507—30 Kohm
Resistor 508—39 Kohm
Resistor 510—330 Kohm
AUDIO IC Amplifier 512—ARCHER PA-263
Resistor 514—39 Kohm
Resistor 503—10 Kohm
Capacitor 516—4.7 microfarad
Resistor 518—3 Kohm
Capacitor 520—500 microfarad
Resistor 522—150 Kohm
Resistor 524—22 Kohm
Capacitor 526—0.1 microfarad
Capacitor 528—0.002 microfarad
Resistor 530—18 Kohm In FIG. 6 are shown the block diagram details of a portion 432 of the personality circuit 430 (FIG. 10). This portion 432 relates to the detection of the amount of force 210 being applied to the sensor 45. The signal on lead 54 from sensor 45 is inputted into a peak detector 600 which functions to provide an output signal on lead 610. The peak 600 provides a steady state ANALOG signal on lead 610 which is representative of the highest magnitude reached by the force signal appearing on lead 54. Hence, the peak detector latches onto the highest magnitude force signal appearing on lead 54 and delivers that signal onto lead 610. Lead 610 accesses a hysterisis rate of rise circuit 620 and an analog to digital converter circuit 630. The purpose of the hysterisis rate of rise circuit 620 is to provide a time frame during which the peak detector 600 functions. At the end of that time frame, the hysterisis rate of rise circuit delivers a READ NOW signal on lead 625 which accesses the converter 630.

In operation, the highest signal peak appearing on lead 610 when the READ NOW signal accesses the converter 630 is stored in the converter 630. Once the information is read into the converter 630, the converter 630 generates a DATA VALID signal on lead 640 for delivery into a request control circuit 650 which in turn generates a RESET pulse over lead 660 for resetting the peak detector circuit 600 and for generating an interrupt request signal, IRQ, on lead 670. At this point, the converter 630 has stored the analog value appearing on lead 610 which is proportional to the largest force 210 sensed by pressure sensor 45. The purpose of the converter circuit 630 is to convert that analog information into a binary signal appearing on leads 680. As will be subsequently discussed, the control unit 20 is responsive to the interrupt request signal IRQ appearing on lead 670 for processing the binary signals appearing on leads 680.

Figure 7:
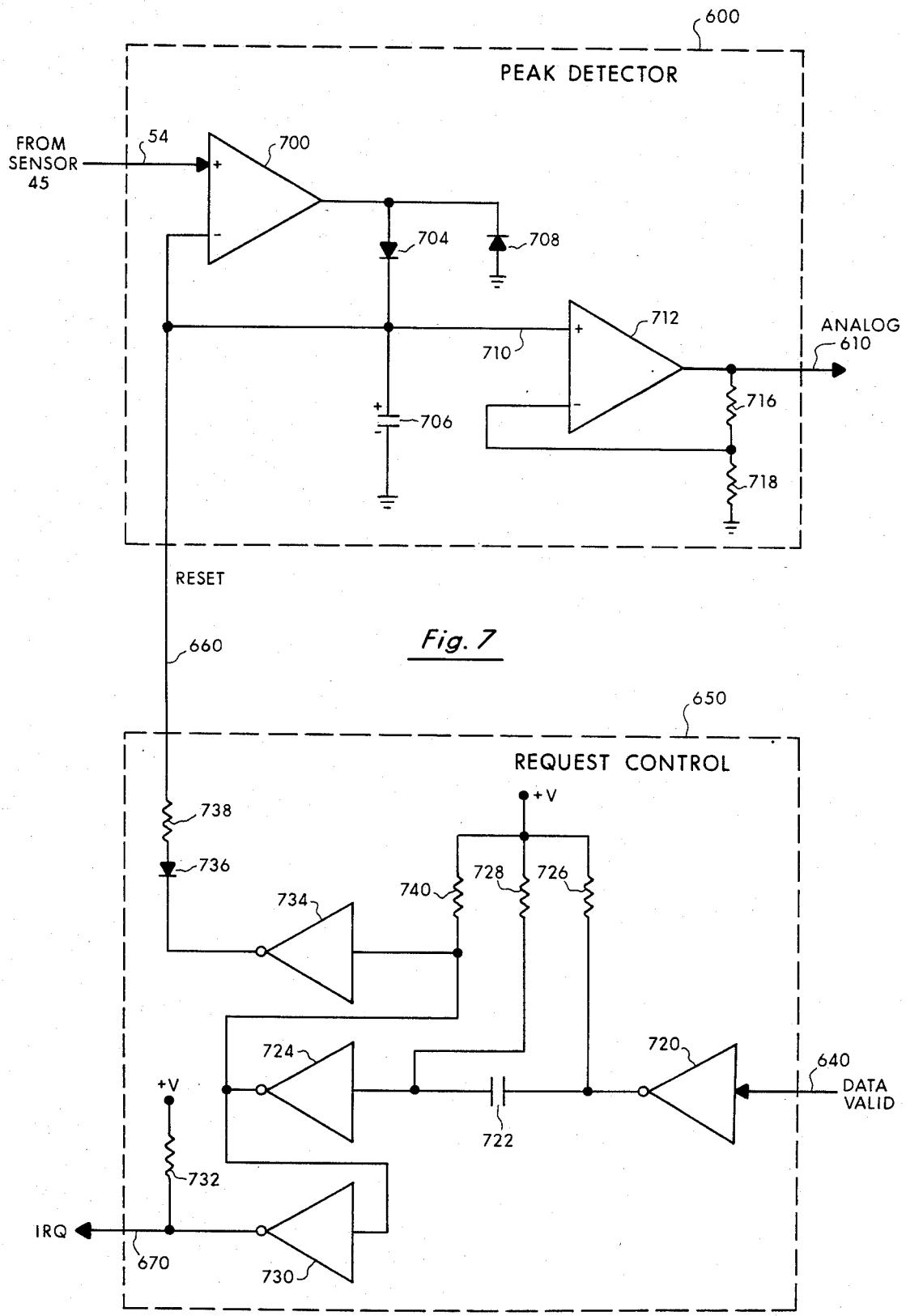
FIG. 7 is an electrical circuit diagram of the peak detector and request control circuits of the present invention.

The details of the peak detector circuit 600 are shown in FIG. 7. The signals appearing on lead 54 from sensor 45 over the personality channel 50 inputs the PLUS side of operational amplifier 700. The output of operational amplifier 700 is delivered through diode 704 and through capacitor 706 to ground. The output of the operational amplifier 700 charges capacitor 706 through the highest level appearing at the output and diode 704 holds the capacitor 706 at its highest voltage value. Diode 708 is interconnected to the output of operational amplifier 700 and is provided so that the negative going portions of the output are grounded. The voltage across the capacitor 706 is delivered on lead 710 into the PLUS side of a second operational amplifier 712. The output of amplifier 712 is fed back through resistor 716 into the MINUS side of the operational amplifier and is further delivered through resistor 716 into resistor 718 to ground. The input of operational amplifier 712 appearing on lead 710 is firmly clamped to the highest voltage level achieved by capacitor 706. The peak detector circuit 600 is reset by lead 660 going to ground in order to discharge the capacitor 706 and to deactivate amplifier 700. When the ground signal on lead 660 is removed, the peak detector functions again to clamp the highest voltage in the signal on lead 54.

In the preferred embodiment, the following components are used:

Operational Amplifier 700 and 712—Texas Instruments UA741
Capacitor 706—1 microfarad
Resistor 716—10 kilohm
Resistor 718—5 kilohm In FIG. 9, the oscillatory signal 900 proportional to the force 210 from the sensor 45 appearing on lead 54 is illustrated. The output signal 910 appears on lead 610. It can be observed in FIG. 9, that the peak detector circuit 600 quickly detects the highest peak of signal 900 and clamps onto it. The voltage scales in FIG. 9 are for illustration purposes only.

In operation, and with reference back to FIG. 1, when a user strikes a sports training device (60, 80, 100, or 120) containing a sensor 45 (or 84), the applied force 210 causes a certain "ringing" in the resulting signals generated by the sensor 45. It is the purpose of the present invention 10 to measure the force of the impact and hence detecting the highest peak of force in signal 900 becomes important. Peak detector circuit 600 performs this task by generating output signal 910 on lead 610.

Figure 8:
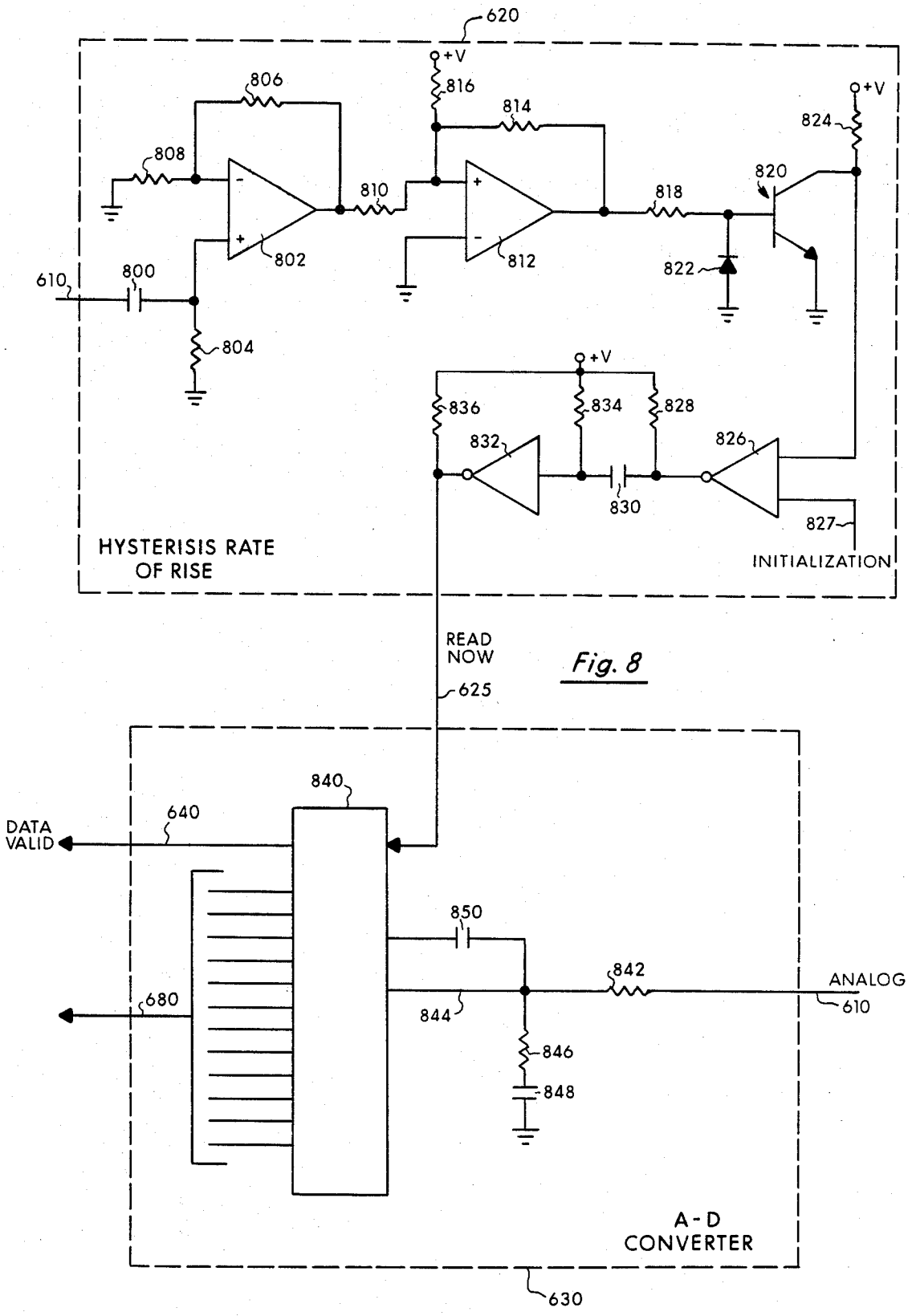
FIG. 8 is the circuit diagram for the hysterisis rate of rise and analog digital converter circuits of the present invention.

The hysterisis rate of rise circuit 620 is shown in FIG. 8. The peak signal 910 appearing lead 610 is delivered through capacitor 800 to the PLUS side of operational amplifier 802 and is also delivered through, capacitor 800 through resistor 804 to ground. The output of operational amplifier 802 is fed back through resistor 806 to the MINUS input of the operational amplifier 802 which is also grounded through resistor 808. The purpose of operational amplifier 802 is to detect the rate of rise appearing on pulse 910 and to amplify that signal. The output of amplifier 802 is delivered through resistor 810 into the PLUS input of the second operational amplifier 812 which has its MINUS input grounded. The output of amplifier 812 is fed back through resistor 814 to the PLUS input which is biased through resistor 816 to positive voltage. The output of amplifier 812 is further delivered through resistor 818 into the base of transistor 820. The base of transistor 820 is fed through a diode 822 to ground. The emitter of transistor 820 is grounded and the collector of transistor 820 is biased through resistor 824 to positive voltage and the collector is further tied to the input of inverter 826. Inverter 826 also receives an INITIALIZATION PULSE whose purpose will be discussed subsequently. The output of inverter 826 is tied through resistor 828 to positive voltage and is further interconnected through capacitor 830 into the input of the second inverter 832. The input to inverter 832 is also tied through resistor 834 to positive voltage and the output of inverter 832 is tied through resistor 836 to positive voltage and is delivered on lead 625 as a READ NOW pulse. The output on lead 625 is shown in FIG. 9 as pulse 920.

An INITIALIZATION signal on lead 827 causes inverter 826 to generate a pulse, like pulse 920, upon start-up of the system. This feature is important for another aspect. In various sport training devices such as balls 60 or bags 120, the existing forces could vary over time and, the existing force, could vary, for example, from one bag 120 to another bag 120. By providing an INITIALIZATION pulse, a reading of the existing force in the bag is made and, as subsequently discussed, stored in the control unit as a value to offset the pressure readings produced by the peak detector circuit 600.

As shown in FIG. 9, the hysterisis rate of rise circuit 620 generates a pulse 920 after a predetermined time period, $\Delta T$. The time period commences with a predetermined rate of rise in the signal 910. At the end of the predetermined time period, a reading is made.

In the preferred embodiment of rate of rise circuit 620, the components are:

Operational amplifier 802, 812—Texas Instruments UA741
Inverters 826, 832—Signetic Corporation 7400 and 7404
Transistor 820—2N5129
Resistor 804—0.5 Meg Ohm
Resistor 806—100 Kilo Ohm
Resistor 808—15 Kilo Ohm
Resistor 810—5.1 Kilo Ohm
Resistor 814—4.7 Meg Ohm
Resistor 816—100 Kilo Ohm
Resistor 818—4.7 Kilo Ohm
Resistor 824—10 Kilo Ohm
Resistor 828—10 Kilo Ohm
Resistor 834—10 Kilo Ohm
Resistor 836—10 Kilo Ohm
Capacitor 800—0.1 micro farad
Capacitor 830—0.1 micro farad.

The READ NOW pulse 920 is delivered on lead 625 to the A-D converter 630 and into an integrated circuit chip 840. The READ NOW pulse causes the integrated circuit chip 840 to read in the value of the ANALOG signal appearing on lead 610 from the peak detector circuit 600. This signal is delivered on lead 610 into resistor 842 and to the chip 840. The input 844 to the chip 840 is also tied through resistor 846 and capacitor 848 to ground. The input is also tied back through capacitor 850 to the chip 840. The analog signal appearing on 610 is fully buffered at this point to meet the input requirements of chip 840.

The integrated circuit chip 840 is commonly termed an analog to digital converter having a latch output. The purpose of converter 840 is to convert the magnitude of the analog electrical signal 910 which is proportional to the amount of force 210 into its binary equivalent. The first output from the chip 840 is a DATA VALID signal on lead 640 which accesses the request control 650 shown in FIG. 7. The second output comprises the actual binary information appearing on leads 680 which is the binary equivalent of the analog signal on lead 610.

In summary the converter 630 is operative upon receipt of the READ NOW pulse 920 to convert the magnitude of the ANALOG signal 910 into a binary value and store that value. Upon completion of conversion and storage, a DATA VALID pulse is generated. In the preferred embodiment shown in FIG. 8, the various components are:

Converter 840—Datel Systems ADC ET12BC
Resistor 842—1 Meg Ohm
Resistor 846—100 Ohm
Capacitor 848—270 pico farad
Capacitor 850—68 pico farad.

Returning back to FIG. 7, when the request control circuit 650 receives the DATA VALID pulse on lead 640, the pulse is delivered through an inverter 720 the output of which is interconnected through capacitor 722 to inverter 724. The output of inverter 720 is further tied through resistor 726 to positive voltage. The input to inverter 724 is also tied to positive voltage through resistor 728. The output of inverter 724 is delivered to the input of inverter 730 whose output is the interrupt request signal, IRQ, on lead 670. The output of inverter 730 is further tied through resistor 732 to positive voltage. Now, the output of inverter 724 is further delivered to the input of inverter 734 whose output is delivered through diode 736 and resistor 738 onto lead 660 which delivers a RESET pulse to the peak detector circuit 600. Finally, the output of inverter 724 is tied through resistor 740 to positive voltage.

In operation, the DATA VALID pulse on lead 640 is delivered to the reset control 650 to generate on lead 660 a RESET pulse and the interrupt request, IRQ, output on lead 670. The inverters 720, 724, 730 and 734 are required to provide proper polarity and driving power. In the preferred embodiment the following are used:

Inverters 720, 724, 730, 734—Motorola 7405
Resistors 726, 728, 732, 740—10 Kilo Ohm
Resistor 738—1 Kilo Ohm
Capacitor 722—1 micro farad In FIG. 10, the remainder of the personality circuit 430 is shown to include the portion 432 priorly discussed for FIG. 6 and an input circuit 1000. As previously discussed, the sensor 45 produces an analog response 900 which appears on lead 54 and is processed by the portion 432 of personality circuit 430 into a binary equivalent on leads 680. Circuit 432 also generates the interrupt request, IRQ, on lead 670. These are received by the input circuit 1000. The input circuit 1000 interfaces the personality circuit portion 432 with the control unit 20 over a data bus 1010 and over an address bus 1020. There are also other interconnections between the personality circuits 430 and the control unit 20 which will be discussed in the following in greater detail.

Essentially, the operation of each personality circuit 430 provides communication capabilities with the stimulus indicators 40 and the sensors 45. The measurement information as to the force applied to a sensor 45 is stored in the input circuit 1000 as set forth in greater detail in FIG. 11.

FIG. 11 essentially shows interconnections to an integrated circuit chip 1100 of the type manufactured by Rockwell International as Model No. 6522. Integrated circuit chip 1100 receives the binary data over leads 680 relating to the magnitude of the force hitting the sensor 45 from the A/D converter circuit 630. It also receives the interrupt request IRQ over lead 670 from the request control 650. The integrated circuit chip 1100 further provides the stimulus signal on lead 52 for the stimulus circuit 40. Chip 1100 is interconnected with the address bus 1020, the data bus 1010, a read/write control 1110, an enable control 1120, a timing control 1130, a reset control 1140, and an interrupt 1150. Collectively these leads are termed 1030. The purpose of chip 1100 is to receive the binary data 680 as to the magnitude of the applied force and store it. Under control of control unit 20, the chip 1100 will be addressed on the address bus 1020 in order to obtain the magnitude of the force, in binary value, on the data bus 1010.

Also shown in FIG. 10 is a general block diagram of the control unit 20. The control unit 20 includes an oscillator 1032 which generates a series of timing pulses on lead 1034 for providing clock pulses to a microprocessor 1036. A reset circuit 1038 accesses the microprocessor 1036 over leads 1040 to provide an overall reset of the system. The microprocessor 1036 receives information on the data bus 1010 and delivers information on the address bus 1020. The microprocessor 1036 also provides a set of timing pulses over leads 1042 to a timing circuit 1044.

Figure 12:
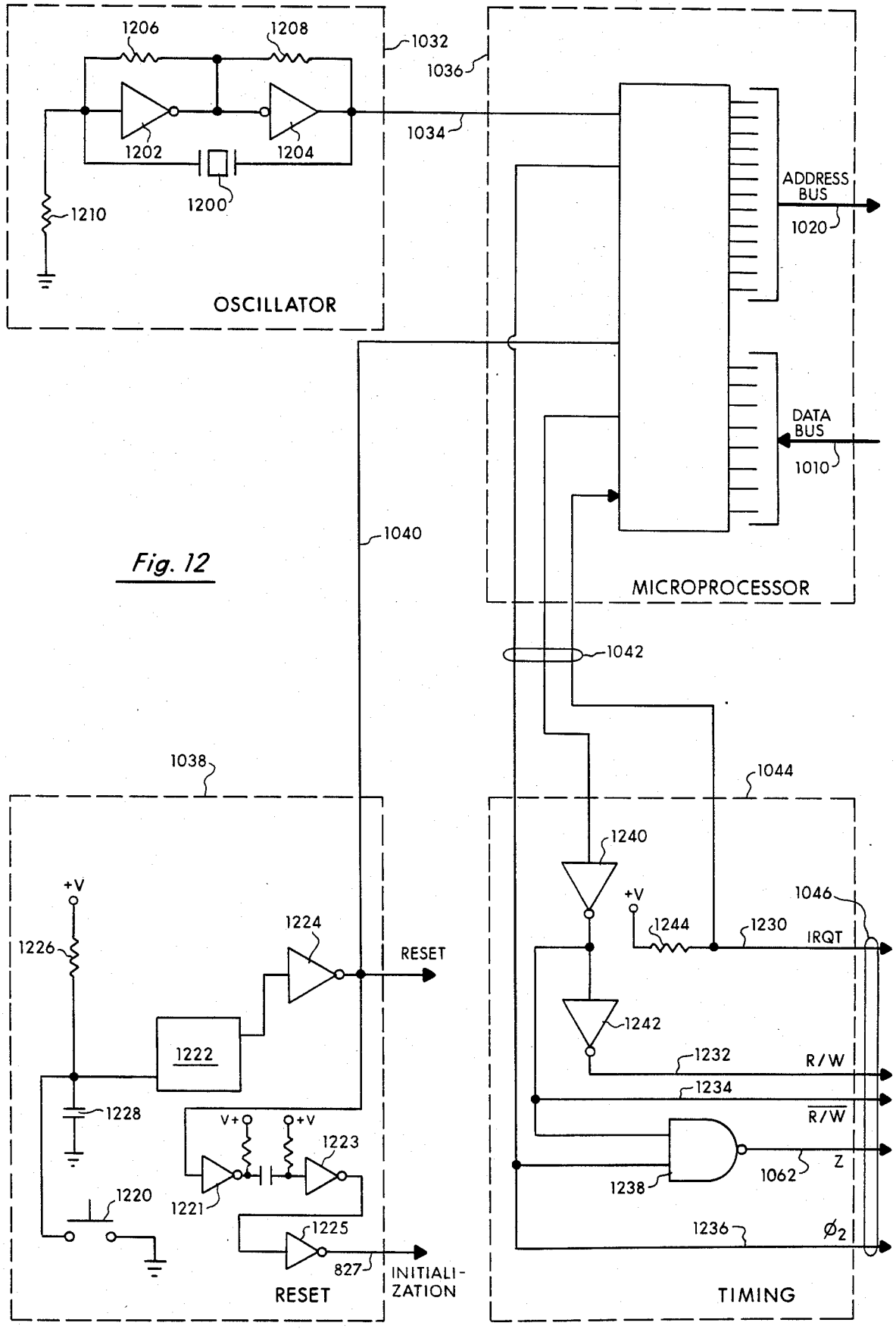
FIG. 12 is the electronic circuit diagram for the oscillator, microprocessor, reset, and timing circuits of the present invention.

The details of the oscillator 1032, the microprocessor 1036, the reset circuit 1038, and the timing circuit 1044, are shown in FIG. 12. The oscillator utilizes a crystal oscillator 1200 interconnected across two series connected chips 1202 and 1204 which are conventionally available from Texas Instruments as Model No. 7404. A pair of resistors 1206 and 1208 bridge each chip. One end of the crystal oscillator 1200 is tied through resistor 1210 to ground. The oscillator functions to provide a series of pulses on lead 1034 at a frequency of 1 MHz.

The microprocessor 1036 utilizes a Rockwell International chip identified as Model No. 6504. The address bus 1020 and the data bus 1010 are conventionally interconnected to this chip. The reset circuit 1038 utilizes a push button switch 1220 having one end interconnected to ground and the other end delivered into the input of chip 1222 which is conventionally available from Signetics Corporation as Model No. 555. The output of chip 1222 is delivered into the input of an inverter 1224 available from Texas Instruments as Model No. 7404. Across the input to chip 1222 is a resistor 1226 tied to positive voltage and a capacitor 1228 tied to ground. Chip 1222 is conventionally interconnected to provide a reset pulse on lead 1040 for the microprocessor 1036. The output of gate 1224 is connected to the input of inverter 1221 which has its output tied to positive voltage and which further has its output connected through a capacitor to the input of inverter 1223. The output of inverter 1223 is then inverted by inverter 1225 and delivered to lead 827 as the INITIALIZATION pulse.

The timing circuit 1044 is interconnected with the processor 1036 over leads 1042. The timing circuit 1044 provides a series of timing pulses on leads 1046. These timing pulses are identified as IRQT on lead 1230, R/W on lead 1232, $\overline{R/W}$ on lead 1234, Z on lead 1062, and $\phi/2$ on lead 1236. The signal on lead 1062 is generated by a NAND gate 1238 interconnected with the microprocessor over leads 1042. The signal on leads 1232 and 1234 are READ/WRITE signals and are generated by a pair of inverters 1240 and 1242 interconnected with one of the leads 1042 from the microprocessor 1036 to provide READ/WRITE pulses. And, the signal on lead 1230 which is termed an interrupt request signal is tied through resistor 1244 to positive voltage.

Returning now to FIG. 10, the control unit 20 further includes a system control 1050 interconnected with the address bus 1020 for producing a series of control pulses. The system control 1050 delivers control pulses over leads 1052 to a read only memory (ROM) 1054, it delivers a control pulse over lead 1056 to a random access memory (RAM) 1058, and it delivers control pulses over leads 1060 to each individual personality circuits 430. Both the read only memory 1054 and the random access memory 1058 are interconnected with the address bus 1020 and data bus 1010. The random access memory is further interconnected over leads 1062 with the timing circuit 1044. These circuits function to provide system control and memory for the present invention.

In FIG. 13 details of the system control 1050 are shown. An integrated circuit chip 1300, conventionally available from Texas Instruments as Model No. 7442 receives an address from the address bus 1020 to provide a one-out-of-N decode. One control lead 1056 from chip 1300 is delivered to the random access memory 1058, four of the control leads 1052 from chip 1300 are delivered to the read only memory 1054 and three of the control leads from chip 1300 are delivered into a set of OR-gates commonly designated 1310. One of the address bus leads 1020 access an inverter 1320 whose output is delivered to a second inverter 1330. The outputs of inverters 1320 and 1330 are delivered into the OR-gate circuit arrangement 1310 to provide fixed output control leads, four of the output control leads 1060 are delivered to the personality circuits 430, one is delivered to the keyboard on lead 1340, and one is delivered on lead 1350 to the display.

In FIG. 14 are shown the details of the read only memory 1054 to include a plurality of read only memory integrated circuit chips 1400 which are conventionally available from Advanced Micro Devices as Model No. 2708. Each read only memory chip 1400 is selectively addressed by the address bus over leads 1020 and the information is selectively outputted from the read only memory chip 1400 onto the data bus 1010. The control leads 1052 from the system control 1050 in FIG. 13 select which read only memory chip 1400 is to be read.

In FIG. 15 are shown the details of the random access memory 1058. The random access memory 1058, in the preferred embodiment, includes two random access memory chips 1500 and 1510. Each random access memory chip 1500 and 1510 is interconnected with the data bus 1010 and the address bus 1020. A timing control lead, Z, 1062 is provided from the timing circuit 1044 and a control lead 1056 is provided from the system control circuit 1050. The random access memory chips 1500 and 1510 are conventionally available from Rockwell International as Model No. 2114.

FIG. 16 sets forth the block diagram details of the display 1600 and keyboard 1610 of the present invention. The display 1600 is controlled by a display control 1620 which communicates with both the data bus 1010 and the address bus 1020. The display control 1620 is controlled by timing information on leads 1046 from the timing circuit 1044 shown in FIG. 12 and is further controlled by leads 1340 and 1350 from the system control 1050 shown in FIG. 13. Furthermore, the display control 1620 generates a timing signal $Z_2$ on lead 675 which accesses the input circuit 1100 shown in FIG. 11. The display control communicates with the display over leads 1630.

The keyboard 1610 is under control of a keyboard control circuit 1640 which also communicates with the address bus 1020 and data bus 1010. The keyboard control 1640 is controlled by the system control 1050, FIG. 13, over lead 1340 and receives timing pulses over lead 1046 from the timing control 1044 in FIG. 12. The keyboard control communicates with the keyboard over leads 1650.

The purpose of the circuitry shown in FIG. 16 is to provide input information from the keyboard 1610 into the system and to provide displayed output information in the display 1600.

The details of the keyboard 1610 and the keyboard control 1640 are shown in FIG. 17. The keyboard control utilizes an integrated circuit chip 1700 such as Model No. 6522 manufactured by Rockwell International which communicates with the address bus 1020 and the data bus 1010. The chip 1700 is interconnected with the system control via lead 1340, the timing $\phi 2$ via lead 1236 and the R/W lead 1232 and with the reset via lead 1040 and IRQT via lead 1230. The keyboard control chip 1700 is further interconnected with the keyboard 1610 which is conventionally available from ECO Switch Corporation and Stackpole Inc. The keyboard 1610 provides an electronic matrix of switches wherein the outputs of these switches are interconnected over leads 1650 and chip 1700. The matrix cross points in FIG. 17 are identified through an alphanumeric designation. The first cross points being A1, A2, etc.

FIG. 18 sets forth the details of the display control 1620 which utilizes an integrated circuit chip 1800 manufactured by Rockwell International as Model No. 6522. Chip 1800 communicates with the address bus 1020 and the data bus 1010 and is further interconnected to the timing circuit 1044 via the R/W lead 1232 and the $\phi_2$ lead 1236, interconnected with the reset circuit 1038 via lead 1040 and is interconnected with the system control 1050 via lead 1350. Finally it receives the IRQT lead 1230 from the timing circuit 1044 in FIG. 12. The output of chip 1800 is interconnected with a series of output drivers 1810. One portion of chip 1800 provides the display data 1630 and a second portion provides the display address both of which are termed 1630. Finally, the display control circuit 1620 provides a two second time out Z2 on lead 675 which accesses the input control 1100 shown in FIG. 11.

Figure 19:
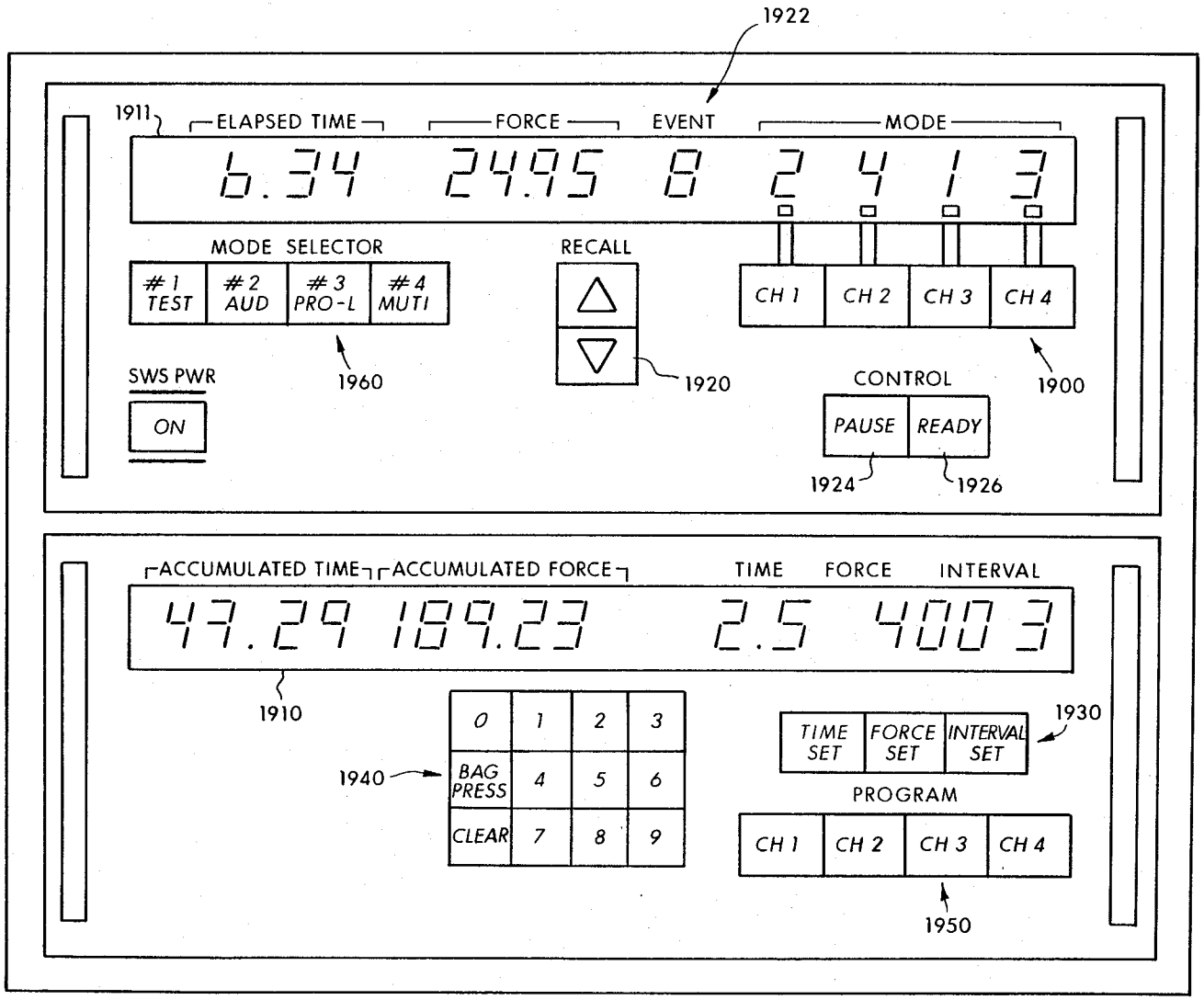
FIG. 19 is an illustration of the display of the present invention.

The various display and input switches are set forth in FIG. 19. The following relationship exists between the matrix alpha-numeric designations of the keyboard shown in FIG. 17 and the switches shown in FIG. 19:

MODE SELECTOR
- A1-TEST
- A2-AUDIO
- A3-PRO-L
- A4-MULTI

CHANNEL SELECT
- B1-CH1
- B2-CH2
- B3-CH3
- B4-CH4

RECALL
- C1-UP
- C2-DOWN

BAG PRESSURE—C3
- CLEAR-C4

CONTROL
- D1-PAUSE
- D2-READY

KEYPAD
- E1-0
- E2-1
- E3-2
- E4-3
- E5-4
- F1-5
- F2-6
- F3-7
- F4-8
- F5-9
- TIME SET—G1
- FORCE SET—G2
- INTERNAL SET—G3

PROGRAM
- H1-CH1
- H2-CH2
- H3-CH3
- H4-CH4

Figure 20:
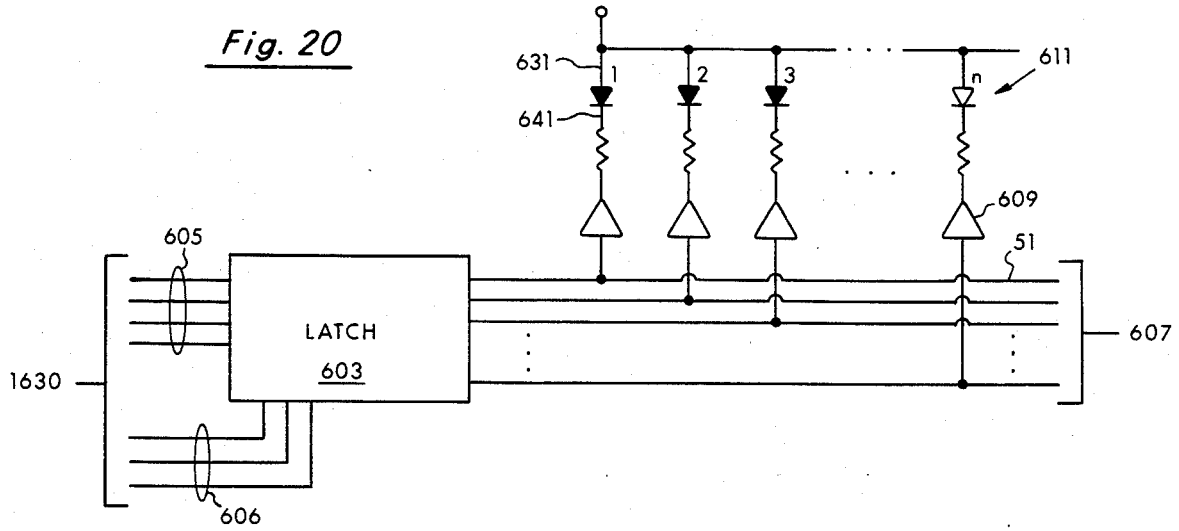
FIG. 20 is the schematic of the stimulus drive circuit.

In FIG. 20 are shown the stimulus indicators 611 for each channel which, as shown in FIG. 5, are connected to leads 631 and 641. Each indicator 611 is driven by a drive circuit 609 residing in the control unit of FIG. 10. The latch circuit (Signetics Corporation Model No. 74LS175) latches data on bus 605 when strobed by an address on bus 606. Buses 605 and 606 are from the DISPLAY DATA AND ADDRESS BUSES 1630 of FIG. 18. Leads 607 are the latched outputs of latch 603 and drive line 51 of FIG. 5.

The operation of the system will now be described. On the initial power turn on or wake-up, the system initializes all read outs in the display shown in FIG. 19. Next, the existing force value of each sport training device (such as 60, 80, 100, or 120) is measured. This occurs through the initialization circuit 621 shown in FIG. 6 as the personality circuit 432. The initialization circuit 621 is connected to lead 827 from the Reset Circuit 1038 of FIG. 12. The existing forces in the sensor 300 occurs on line 54 and a pulse on the initialization circuit 621 causes the hysterisis rate of rise circuit 620 to read the existing forces from sensor 45. This is then stored in the random access memory 1058 for use by the control unit 20. The control unit 20, in its normal operation of reading applied forces at sensor 45 will subtract the existing forces reading from the magnitude of the electrical signal appearing on lead 680. Hence, the true value of the force 210 applied to sensor 300 will be ascertained. This function is important to the overall operation of the present invention in that, for example, when football 60 gains or loses pressure different force readings may be present. Furthermore, as a particular sport device ages through time and use, its existing force characteristics can change. Under the teachings of the present invention, however, all such changes and existing force conditions will be compensated for. This also provides greater flexibility for the feedback training system of the present invention by making it flexible enough to be used for different sport devices without any other adjustments.

By pushing the CH1, CH2, CH3, or CH4 switches, shown in FIG. 19, and commonly designated 1900, the elapsed time or reaction time (ELAPSED TIME) and the applied force (FORCE) can be displayed in display 1911. The reaction time for a series of events (ACCUMULATED TIME) and the total force for a series of events (ACCUMULATED FORCE) can be indicated in display 1910.

The reaction time (ELAPSED TIME) is the time from the emanation of a stimulus or ready signal by stimulus indicator 40 and the time when the personality circuit 432 receives the applied force signal. The microprocessor 1036 can then determine the reaction time between these two occurrences and display that reaction time in display 1911 as previously discussed for FIG. 16. An applied force (FORCE) as determined in the personality circuit 432 of FIG. 6 is determined by the microprocessor 1036 and displayed in display 1911 in a similar fashion. The magnitude of the applied force, however, as previously mentioned, is offset by the existing force reading of the particular sport training device.

The ACCUMULATED TIME and the ACCUMULATED FORCE for a series of events for any given READY signal from the stimulus indicator 40 can be determined by the control unit 20 by storing each individual reaction time and applied force in the random access memory 1058. Then as each event is recorded within the predetermined time frame by use of 1930, 1940 and 1950 (to be discussed), of the signal emanated by the stimulus indicator 40, the overall accumulation is determined and displayed in display 1910 as each event occurs. This can go on for a predetermined number of ready signal emanations.

Hence, by pushing switches CH1, CH2, etc. the ACCUMULATED TIME, ACCUMULATED FORCE, ELAPSED TIME and FORCE for each particular channel will be displayed. Hence, the user of the present invention can monitor one channel or the user can selectively choose a particular channel in a predetermined sequence.

The RECALL push button 1920 retrieves from the random access memory 1058 information, in the preferred embodiment, of up to eight events for a ready signal emanation for each selected channel.

The EVENT display 1922 sets forth the event number for the information being displayed in displays 1910 and 1911. Hence, if the feedback training system of the present invention is currently on event number 4 (or the fourth recorded event within the emanation of a ready signal), then the display 1922 will display the number 4.

The PAUSE button 1924 operates as follows. The desired channel select push button 1900 is first pressed followed by (in the preferred embodiment, within five seconds) pressing the PAUSE button to stop all operations of the selected channel. This basically provides a start/stop function for the system of the present invention between the sequencing or repetition of the ready signal emanations from sensor 40.

The READY button 1926 activates the control unit 20 to commence generation of the emanation of the stimulus ready signals. When the READY button 1926 is depressed, a three to five second random wait is initiated before the system of the present invention issues a ready signal. The purpose of this is to exclude precipital action by the user of the present invention.

A predetermined amount of reaction time, a predetermined amount of force, and a predetermined time interval control can be selectively set by pushing switches 1930 and by inputting the desired value with keyboard 1940. Particular channels can be selected by activating push button switches 1950. Hence, if it is desired, in channel 3, to put in a predetermined reaction time of 2.5 seconds, and a predetermined force of 400, and if this sequence is to repeat at intervals of 3 seconds, this information can be programmed into the control unit 20 through switches 1930, 1940, and 1950.

In the event that a ready signal is generated and the user of the system of the present invention is unable to react in time as set by the time setting switch, then the control unit 20 of the present invention functions to deliver a miss signal or, in the preferred embodiment, a tone in loud speaker 500 of the stimulus circuit shown in FIG. 5. This provides feedback to the user that his reaction time is not fast enough. The same type of situation is true for the predetermined force setting. In this mode of operation, if the user of the present invention is unable to deliver a predetermined amount of force as set by switches 1930 and 1940, then a low force signal will be generated in loud speaker 500. The TIME set, in the preferred embodiment, is programmable in a range between 0.1 second to 9.9 seconds. The FORCE set, in the preferred embodiment, is programmable between 001 units to 655 units (in the preferred embodiment, force displayed in psi times two). The INTERVAL set, which is the time interval between the emanations of the stimulus indicator 40, is programmable between one second to nine seconds. It is important to understand that although the time interval is set by utilizing switches 1930, 1940, and 1950 in control unit 20 there is an actual time interval created by randomly adding or subtracting time from the indicated setting. The interval set, therefore, indicates a mean time selected and the actual time interval may vary as much as 30% plus or minus from the mean time. This type of randomness is important for athletes using the present invention to prevent them from anticipating what the time interval is.

The MODE SELECTOR switches 1960 select the operation in which the system of the present invention functions. In the TEST mode only one ready signal is issued by the stimulus indicator 40. In this mode, all operations cease after the ready signal is emanated, the applied force is sensed, and the reaction time and the applied force is determined and displayed.

In the audible (AUD) mode of operation, the tone generator is activated to mid-scale upon the ready signal emanation by the stimulus indicator 40. When the applied force is sensed, the frequency of the tone generator is adjusted down to 50 hertz for the smallest peak sense and, as high as 10,000 hertz for the greatest peak sensed. The tone persists from event to event and the elapsed time and force are displayed for each event and recorded. In this fashion, the tone is constant until the next event and, therefore, if the user of the present invention receives a low frequency tone, he or she knows that the tone represents a force which is too low or perhaps not acceptable. In the next event or in response to the low frequency tone, the user of the present invention will strive to achieve a greater applied force which will result in a higher frequency tone.

In the proficiency level (PRO-L), the present invention functions using the programmable time, force, and interval set as previously discussed. If enough force is applied to the sensor 45 within a predetermined amount of time, the stimulus indicator 40 becomes extinguished. If the time and force criteria, as set, has not been met, a two second activation of the tone generator 500 occurs from $Z_2$ in FIG. 18 and the stimulus indicator will remain on until enough force is accumulated.

Figure 21:
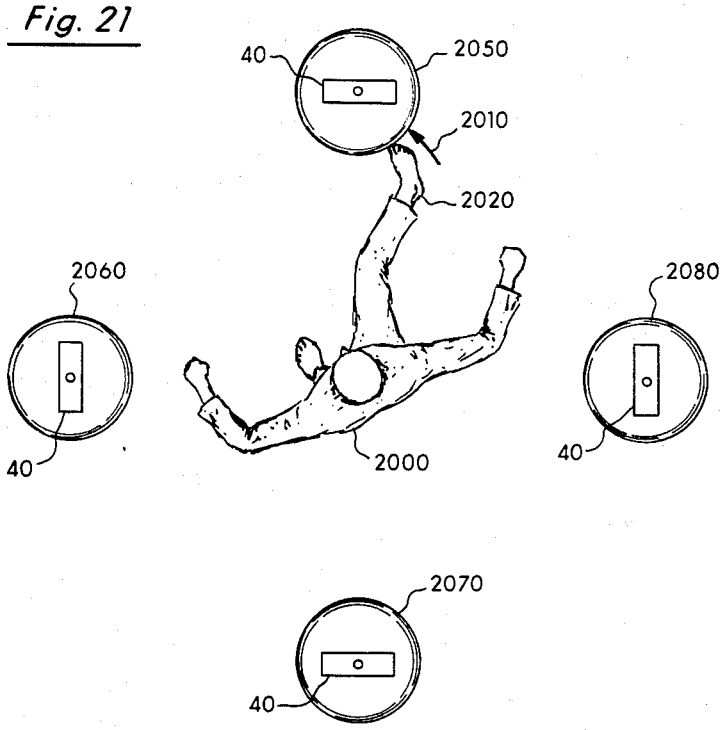
FIG. 21 is an illustration of the present invention being used in a martial art training exercise.

In the multi device mode of operation (MULTI), when the ready sequence has been initiated and the three to five second random WAIT sequences for each channel have been set, the system functions using the programmable TIME, FORCE, and INTERVAL SETTINGS of operation. In this mode of operation, the present invention functions to use any combination of the four channels, CH1, CH2, CH3, and CH4. The ready signal is emanated from the stimulus indicator 40 in a random fashion from channel to channel. This is best shown by reference to FIG. 21 wherein a user 2000 of the present invention is applying a force 2010 by means of his foot 2020 to one of four body bags 2050, 2060, 2070, and 2080. Each body bag has associated with it and at a location near it a stimulus device 40 for emanating a ready signal. In the multi-device mode of operation, the user 2000 is randomly given a ready signal by the associated stimulus indicator 40. The user then applies the force 2010 to the selected bag 2050. The reaction time and applied force can be measured as previously indicated. Hence, the emanation of the ready signal from a stimulus indicator 40 occurs in this mode of operation both spacially (from one of four body bags) and temporally in time. Such a mode of operation is useful for example in the martial arts sports wherein the system of the present invention provides effective feedback training both to reaction time and applied forces.

Although the system of the present invention has been described in particular detail, in the preferred embodiment, the teachings of the present invention transcend its preferred embodiment and are set forth in the following claims.

We claim:

1. A reaction time and applied force feedback training system for a sport activity having at least one sport training device (60), said system further comprising:

an input keyboard (1640) for providing signals in response to manually preset values corresponding to (a) a predetermined reaction time, (b) a predetermined level of applied force, and (c) a predetermined repetition timing sequence, a stimulus indicator (40) located near but physically separated (401) from each said at least one sport training device (60) for emanating a plurality of ready signals (74), each of said ready signals (74) signaling the user of said system to apply a manual force (210) to said at least one sport training device (60), said stimulus indicator (40) being further capable of emanating a miss signal, a sensor (45) operatively connected to each said at least one sport training device (60) receptive of forces resulting from said manual force (210) applied by said user, to any location on said sport training device (60), for generating an electrical signal (900), said electrical signal (900) having a magnitude proportional to the magnitude of said manually applied force (210), a personality channel (430) in communication with both said stimulus indicator (40) and said sensor (45), said personality channel (430) comprising:

(a) means (600) in communication with said sensor (45) for detecting the analog value (910) of the highest magnitude of said electrical signal (900) thereby eliminating extraneous signals of lower magnitude caused by ringing of the applied manual force (210) in said at least one sport training device (60), (b) means (630) receptive of said analog value (910) from said detecting means (600) for converting said analog value (910) into a binary applied force signal (680) corresponding to said highest magnitude of said electrical signal, and (c) means (1000) in communication with said stimulus indicator (40) for activating said stimulus indicator (40) to selectively emanate said ready and miss signals, a control unit (20) remote from said stimulus indicator (40) and said sensor (45) and connected to said input keyboard (1640) and to said personality channel (430), said control unit (20) upon initialization of said system being capable of storing a binary existing force signal from said personality circuit (430) corresponding to the existing force on said sensor (45) associated with said at least one sport training device (60), said control unit (20) being receptive of said binary applied force signal from said personality channel (430) and of said binary existing force signal for generating an offset signal corresponding to the true magnitude of said manually applied force (210), said control unit (20) being receptive of said predetermined repetition timing sequence from said input keyboard (1640) for randomly activating said activating means (1000) within said repetition timing sequence in order to emanate said plurality of ready signals, and said control unit (20) being further capable of producing a timing signal corresponding to the actual reaction time between the aforesaid activation of said stimulus indicator (40) and the receipt of said binary applied force signal by said control unit, said control unit (20) being capable of enabling said activating means (1000) in said personality circuit (430) to activate said stimulus indicator (40) in order to emanate said miss signal to said user in the event said manually applied force (210) is less in value than said predetermined level of applied force and in the event said reaction time is less than said predetermined reaction time, and means (1600) connected to said control unit (20) and receptive of said offset signal and of said timing signal for displaying the true magnitude of said manually applied force and the actual reaction time of said user in applying said manual force to said sport training device after each said ready signal.

2. A reaction time and applied force feedback training system for a sport activity having at least one sport training device (60), said system further comprising:

means (1640) for providing signals in response to manually preset values corresponding to (a) a predetermined reaction time, (b) a predetermined level of applied force, and (c) a predetermined repetition timing sequence, means (40) located near but physically separated (401) from each said at least one sport training device (60) for emanating a plurality of ready signals (74), each of said ready signals (74) signaling the user of said system to apply a manual force (210) to said at least one sport training device (60), said emanating means (40) being further capable of emanating a miss signal, means (45) operatively connected to each said at least one sport training device (60) receptive of forces resulting from said manual force (210) applied by said user, to any location on said sport training device (60), for generating an electrical signal (900), said electrical signal (900) having a magnitude proportional to the magnitude of said manually applied force (210), means (430) for communicating with both said emanating means (40) and said generating means 45), said communicating means (430) comprising:

(a) means (600) in communication with said generating means (45) for detecting the analog value (910) of the highest magnitude of said electrical signal (900) thereby eliminating extraneous signals of lower magnitude caused by ringing of the applied manual force (210) in said at least one sport training device (60), (b) means (630) receptive of said analog value (910) from said detecting means (600) for converting said analog value (910) into a binary applied force signal (680) corresponding to said highest magnitude of said electrical signal, and (c) means (1000) in communication with said emanating means (40) for activating said emanating means (40) to selectively emanate said ready and miss signals, control means (20) remote from said emanating means (40) and said generating means (45) and connected to said providing means (1640) and to said communicating means (430), said control means (20) upon initialization of said system being capable of storing a binary existing force signal from said communicating means (430) corresponding to the existing forces on said generating means (45) associated with said at least one sport training device (60), said control means (20) being receptive of said binary applied force signal from said communicating means (430) and of said binary existing force signal for generating an offset signal corresponding to the true magnitude of said manually applied force (210), said control means (20) being receptive of said predetermined repetition timing sequence from said providing means (1640) for randomly activating said activating means (1000) within said repetition timing sequence in order to emanate said plurality of ready signals, and said control means (20) being further capable of producing a timing signal corresponding to the actual reaction time between the aforesaid activation of said emanating means (40) and the receipt of said binary applied force signal by said control means, said control means (20) being capable of enabling said activating means (1000) in said communicating means (430) to activate said emanating means (40) in order to emanate said miss signal to said user in the event said manually applied force (210) is less in value than said predetermined level of applied force and in the event said reaction time is less than said predetermined reaction time, and means (1600) connected to said control means (20) and receptive of said offset signal and of said timing signal for displaying the true magnitude of said manually applied force and the actual reaction time of said user in applying said manual force to said sport training device after each said ready signal

3. A reaction time and applied force feedback training system for a sport activity having at least one sport training device (60), said system further comprising:

an input keyboard (1640) for providing signals in response to manually preset values corresponding to (a) a predetermined reaction time, and (b) a predetermined level of applied force, a stimulus indicator (40) located near but physically separated (401) from each said at least one sport training device (60) for emanating a plurality of ready signals (74), each of said ready signals (74) signaling the user of said system to apply a manual force (210) to said at least one sport training device (60), said stimulus indicator (40) being further capable of emanating a miss signal, a sensor (45) operatively connected to each said at least one sport training device (60) receptive of forces resulting from said manual force (210) applied by said user, to any location on said sport training device (60), for generating an electrical signal (900), said electrical signal (900) having a magnitude proportional to the magnitude of said manually applied force (210), a personality channel (430) in communication with both said stimulus indicator (40) and said sensor (45), said personality channel (430) comprising:

(a) means (600) in communication with said sensor (45) for detecting the analog value (910) of the highest magnitude of said electrical signal (900) thereby eliminating extraneous signals of lower magnitude caused by ringing of the applied manual force (210) in said at least one sport training device (60), (b) means (630) receptive of said analog value (910) from said detecting means (600) for converting said analog value (910) into a binary applied force signal (680) corresponding to said highest magnitude of said electrical signal, and (c) means (1000) in communication with said stimulus indicator (40) for activating said stimulus indicator (40) to selectively emanate said ready and miss signals, a control unit (20) remote from said stimulus indicator (40) and said sensor (45) and connected to said input keyboard (1640) and to said personality channel (430), said control unit (20) upon initialization of said system being capable of storing a binary existing force signal from said personality circuit (430) corresponding to the existing force on said sensor (45) associated with said at least one sport training device (60), said control unit (20) being receptive of said binary applied force signal from said personality channel (430) and of said binary existing force signal for generating an offset signal corresponding to the true magnitude of said manually applied force (210), said control unit (20) being capable of randomly activating said activating means (1000) in order to emanate said plurality of ready signals, and said control unit (20) being further capable of producing a timing signal corresponding to the actual reaction time between the aforesaid activation of said stimulus indicator (40) and the receipt of said binary applied force signal by said control unit, said control unit (20) being capable of enabling said activating means (1000) in said personality circuit (430) to activate said stimulus indicator (40) in order to emanate said miss signal to said user in the event said manually applied force (210) is less in value than said predetermined level of applied force and in the event said reaction time is less than said predetermined reaction time, and means (1600) connected to said control unit (20) and receptive of said offset signal and of said timing signal for displaying the true magnitude of said manually applied force and the actual reaction time of said user in applying said manual force to said sport training device after each said ready signal.

4. A reaction time and applied force feedback training system for a sport activity having at least one sport training device (60), said system further comprising:

means (1640) for providing signals in response to manually preset values corresponding to (a) a predetermined reaction time, (b) a predetermined level of applied force, and (c) a predetermined repetition timing sequence, means (40) loated near but physically separated (401) from each said at least one sport training device (60) for emanating a plurality of ready signals (74), each of said ready signals (74) signaling the user of said system to apply a manual force (210) to said at least one sport training device (60), said emanating means (40) being further capable of emanating a miss signal, means (45) operatively connected to each said at least one sport training device (60) receptive of forces resulting from said manual force (210) applied by said user, to any location on said sport training device (60), for generating an electrical signal (900), said electrical signal (900) having a magnitude proportional to the magnitude of said manually applied force (210), means (430) for communicating with both said emanating means (40) and said generating means 45), said communicating means (430) comprising:

(a) means (600) in communication with said generating means (45) for detecting the analog value (910) of said electrical signal (900), (b) means (630) receptive of said analog value (910) from said detecting means (600) for converting said analog value (910) into a binary applied force signal (680) corresponding to said highest magnitude of said electrical signal, and (c) means (1000) in communication with said emanating means (40) for activating said emanating means (40) to selectively emanate said ready and miss signals, control means (20) remote from said emanating means (40) and said generating means (45) and connected to said providing means (1640) and to said communicating means (430), said control means (20) upon initialization of said system being capable of storing a binary force signal from said communicating means (430) corresponding to the existing force on said generating means (45) associated with said at least one sport training device (60), said control means (20) being receptive of said binary applied force signal from said communicating means (430) and of said binary force signal for generating an offset signal corresponding to the true magnitude of said manually applied force (210), said control means (20) being receptive of said predetermined repetition timing sequence from said providing means (1640) for randomly activating said activating means (1000) within said repetition timing sequence in order to emanate said plurality of ready signals, and said control means (20) being further capable of producing a timing signal corresponding to the actual reaction time between the aforesaid activation of said emanating means (40) and the receipt of said binary applied force signal by said control means, said control means (20) being capable of enabling said activating means (1000) in said communicating means (430) to activate said emanating means (40) in order to emanate said miss signal to said user in the event said manually applied force (210) is less in value than said predetermined level of applied force and in the event said reaction time is less than said predetermined reaction time, and means (1600) connected to said control means (20) and receptive of said offset signal and of said timing signal for displaying the true magnitude of said manually applied force and the actual reaction time of said user in applying said manual force to said sport training device after each said ready signal.

* * * * *

UNITED STATES PATENT AND TRADEMARK OFFICE

CERTIFICATE OF CORRECTION

PATENT NO. : 4,534,557

DATED : August 13, 1985

INVENTOR(S) : Stephen L. Bigelow, John A. Carlin

It is certified that error appears in the above-identified patent and that said Letters Patent are hereby corrected as shown below:

Title page, Item [19] should read --Carlin et al--.

Item [76] should read:

-- INVENTOR(S): John A. Carlin, 1795 S. St. Paul, Denver, CO 80210; Stephen L. Bigelow, 189 Ventor Avenue, Aspen, CO 81611--.

Signed and Sealed this

*Fourteenth* Day of *January 1986*

[SEAL]

*Attest:*

DONALD J. QUIGG

*Attesting Officer*

*Commissioner of Patents and Trademarks*